US008459586B2

(12) United States Patent
Vaughn et al.

(10) Patent No.: US 8,459,586 B2
(45) **Date of Patent: *Jun. 11, 2013**

(54) PROCESS FOR REWINDING A WEB MATERIAL

(75) Inventors: Jeffrey Moss Vaughn, Cincinnati, OH (US); Kevin Benson McNeil, Loveland, OH (US); Michael James Gworek, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1264 days.

This patent is subject to a terminal disclaimer.

(21) Appl. No.: 11/384,114

(22) Filed: Mar. 17, 2006

(65) Prior Publication Data

US 2007/0215741 A1 Sep. 20, 2007

(51) Int. Cl.
*B65H 19/22* (2006.01)

(52) U.S. Cl.
USPC ..... 242/533.3; 242/533.4; 242/533.5

(58) Field of Classification Search
USPC ..... 242/533.3–533.5, 610
See application file for complete search history.

(56) References Cited

U.S. PATENT DOCUMENTS

| | | | | |
|---|---|---|---|---|
| 1,040,188 | A | | 10/1912 | Gray |
| 2,769,600 | A | | 11/1952 | Kwitex et al. |
| 3,630,462 | A | | 12/1971 | Nordgren et al. |
| 3,679,010 | A | | 7/1972 | Bullivant |
| 3,791,602 | A | | 2/1974 | Isakson |
| 3,899,075 | A | * | 8/1975 | Hall et al. ..... 206/411 |
| 4,422,588 | A | | 12/1983 | Nowisch |
| 4,431,140 | A | | 2/1984 | Tetro |
| 4,541,583 | A | | 9/1985 | Forman et al. |
| 4,588,138 | A | | 5/1986 | Spencer |
| 4,687,153 | A | | 8/1987 | McNeil |
| 4,723,724 | A | | 2/1988 | Bradley |
| 4,798,350 | A | | 1/1989 | Jorgensen et al. |
| 4,811,915 | A | | 3/1989 | Smith |
| 4,828,195 | A | | 5/1989 | Hertel et al. |
| 4,856,725 | A | | 8/1989 | Bradley |
| 4,856,752 | A | | 8/1989 | Linn |
| 4,909,452 | A | | 3/1990 | Hertel et al. |
| 4,919,351 | A | | 4/1990 | McNeil |
| 4,955,554 | A | | 9/1990 | LeBoeuf et al. |
| 4,962,897 | A | | 10/1990 | Bradley |
| 4,993,652 | A | | 2/1991 | Moeller |

(Continued)

FOREIGN PATENT DOCUMENTS

| | | |
|---|---|---|
| EP | 0 291 76 B1 | 2/1983 |
| EP | 0 291 767 | 11/1988 |

(Continued)

OTHER PUBLICATIONS

U.S. Appl. No. 11/384,105, filed Mar. 17, 2006, Vaughn, et al.

*Primary Examiner* — Sang Kim
(74) *Attorney, Agent, or Firm* — Peter D. Meyer

(57) ABSTRACT

The present invention provides for a method for rewinding a web material. The method comprises the steps of: (1) Disposing the web material on a winding spindle, the winding spindle being operatively associated with a winding turret; (2) Cooperatively engaging a contact roll with the winding spindle when the web material is disposed therebetween, the contact roll being operatively associated with the winding turret; and, (3) Adjusting the position of the contact roll upon said winding turret relative to the winding spindle as the web material is being disposed upon the winding spindle.

19 Claims, 24 Drawing Sheets

U.S. PATENT DOCUMENTS

| | | | |
|---|---|---|---|
| 5,035,373 | A | 7/1991 | Perrigo |
| 5,054,707 | A | 10/1991 | Olson |
| 5,104,055 | A | 4/1992 | Buxton |
| 5,104,155 | A | 4/1992 | Kirkwood |
| 5,137,225 | A | 8/1992 | Biagiotti |
| 5,190,232 | A | 3/1993 | Brandon et al. |
| 5,226,611 | A | 7/1993 | Butterworth et al. |
| 5,267,703 | A | 12/1993 | Biagiotti |
| 5,285,979 | A | 2/1994 | Francesco |
| 5,312,059 | A | 5/1994 | Membrino |
| 5,335,869 | A | 8/1994 | Yamaguchi et al. |
| 5,368,252 | A | 11/1994 | Biagiotti |
| 5,370,335 | A | 12/1994 | Vigneau |
| 5,402,960 | A | 4/1995 | Oliver et al. |
| 5,431,357 | A | 7/1995 | Ruegg |
| 5,497,959 | A | 3/1996 | Johnson et al. |
| 5,505,405 | A | 4/1996 | Vigneau |
| 5,538,199 | A | 7/1996 | Biagiotti |
| 5,542,622 | A | 8/1996 | Biagiotti |
| 5,565,033 | A | 10/1996 | Gaynes et al. |
| 5,603,467 | A | 2/1997 | Perini et al. |
| 5,660,349 | A | 8/1997 | Miller et al. |
| 5,660,350 | A | 8/1997 | Byrne et al. |
| 5,660,351 | A | 8/1997 | Osanai |
| 5,667,162 | A | 9/1997 | McNeil et al. |
| 5,690,297 | A | 11/1997 | McNeil et al. |
| 5,725,176 | A | 3/1998 | Vigneau |
| 5,732,901 | A | 3/1998 | McNeil et al. |
| 5,735,481 | A | 4/1998 | Loosen |
| 5,769,352 | A | 6/1998 | Biagiotti |
| 5,772,149 | A | 6/1998 | Butterworth |
| 5,779,180 | A | 7/1998 | Smedt et al. |
| 5,810,282 | A | 9/1998 | McNeil et al. |
| 5,839,680 | A | 11/1998 | Biagiotti |
| 5,845,867 | A | 12/1998 | Hould et al. |
| 5,899,404 | A | 5/1999 | McNeil et al. |
| 5,909,856 | A | 6/1999 | Myer et al. |
| 5,913,490 | A | 6/1999 | McNeil et al. |
| 5,979,818 | A | 11/1999 | Perini et al. |
| 6,000,657 | A | 12/1999 | Butterworth |
| 6,056,229 | A | 5/2000 | Blume et al. |
| 6,142,407 | A | 11/2000 | McNeil et al. |
| 6,308,909 | B1 | 10/2001 | McNeil et al. |
| 6,354,530 | B1 | 3/2002 | Byrne et al. |
| 6,488,226 | B2 | 12/2002 | McNeil et al. |
| 6,565,033 | B1 | 5/2003 | Biagiotti |
| 6,595,458 | B1 | 7/2003 | Biagiotti |
| 6,595,459 | B2 | 7/2003 | Hanson |
| 6,648,266 | B1 | 11/2003 | Biagiotti et al. |
| 6,659,387 | B2 | 12/2003 | Biagioni |
| 6,698,681 | B1 | 3/2004 | Guy et al. |
| 6,715,709 | B2 | 4/2004 | Stephens et al. |
| 6,729,572 | B2 | 5/2004 | Baggot et al. |
| 6,752,344 | B1 | 6/2004 | Biagiotti |
| 6,752,345 | B2 | 6/2004 | Betti et al. |
| 6,834,824 | B1 | 12/2004 | Smith |
| 6,866,220 | B2 | 3/2005 | Sosalla et al. |
| 2002/0130212 | A1 | 9/2002 | Yamasaki |
| 2003/0226928 | A1 | 12/2003 | McNeil et al. |

FOREIGN PATENT DOCUMENTS

| | | | |
|---|---|---|---|
| EP | 0 514 226 | A1 | 11/1992 |
| EP | 0 521 396 | | 1/1993 |
| EP | 1 375 402 | B1 | 10/2005 |
| GB | 2 126 564 | | 3/1984 |
| WO | WO 99/02439 | | 1/1999 |
| WO | WO 99/42393 | | 8/1999 |
| WO | WO 01/16008 | A1 | 3/2001 |
| WO | WO 02/055420 | A1 | 7/2002 |
| WO | WO 03/074398 | A2 | 1/2003 |

* cited by examiner

PROCESS FOR REWINDING A WEB MATERIAL

FIELD OF THE INVENTION

The present invention relates to a process for converting large rolls of wound web material into a finally wound product suitable for use by a consumer.

BACKGROUND OF THE INVENTION

Web winders are typically used to form large rolls of wound web material, such as paper and polymeric film materials, known as parent rolls. From the parent rolls, rewinders are employed in order to wind the web material into a rolled product. The rolled product is then cut at designated lengths into the finally wound product. The finally wound products typically created by the machines and processes are toilet tissue rolls, paper toweling rolls, paper rolls, polymeric films, and the like.

There are essentially two types of techniques known in the art for performing the step of rewinding; that is, winding a web material from a parent roll into a rolled product. The first technique used in winding the web material to form a rolled product is known as surface winding. In surface winding, the web material is wound onto the core via contact with belts and/or rotating rolls. A nip is typically formed between these two or more co-acting belt or roller systems. The belts or rollers of such systems typically travel in opposite directions at different speeds. The reason for having different speeds lies in the fact that the core that is being driven by the opposed belts or rollers will advance in the direction of the faster moving belt or roller. Usually, these belts or rollers are divergent so that the rolled product that is being built upon the core will have enough space to grow in diameter and will be able to maintain contact with the two diverging belts or rollers. Exemplary surface winders are disclosed in U.S. Pat. Nos. 3,630,462; 3,791,602; 4,541,583; 4,723,724; 4,828,195; 4,856,752; 4,909,452; 4,962,897; 5,104,155; 5,137,225; 5,226,611; 5,267,703; 5,285,979; 5,312,059; 5,368,252; 5,370,335; 5,402,960; 5,431,357; 5,505,405; 5,538,199; 5,542,622; 5,603,467; 5,769,352; 5,772,149; 5,779,180; 5,839,680; 5,845,867; 5,909,856; 5,979,818; 6,000,657; 6,056,229; 6,565,033; 6,595,458; 6,595,459; 6,648,266; 6,659,387; 6,698,681; 6,715,709; 6,729,572; 6,752,344; 6,752,345; and 6,866,220. The following international applications also provide exemplary surface winders: International Publication No. 01/16008 A1, 02/055420 A1, 03/074398 A2, 99/02439, 99/42393, and EPO Application No. 0514226 A1.

However, such winders can have drawbacks. First, a typical surface winder provides significant contact between the web material and the winding surfaces during winding. This contact during winding can effectively translate winding torque through the web material leading to crushing of embossments that may be disposed upon an embossed material, smudging images disposed upon a web material having an image disposed thereon, and the like. Also, surface winders are known to exhibit winding log instability during the winding of low density products.

The second technique used to wind a web material to form a rolled product is known as center winding. In center winding, a core is rotated in order to wind a web material into a roll around a core. Typically, the core is mounted on a mandrel that rotates at high speed at the beginning of a winding cycle and then slows down as the size of the rolled product being wound upon the core increases in diameter. Center winders work well when the web material that is being wound has a printed, textured, or slippery surface. Additionally, center winders can be useful in producing softer rolled products. Exemplary center winders are discussed in U.S. Pat. Nos. 1,040,188; 2,769,600; 3,697,010; 4,588,138; 5,497,959; 5,660,349; 5,725,176; and U.S. Patent Application No. 2002/0130212 A1.

However, center winders have drawbacks that are known to those of skill in the art. Known drawbacks include the need to provide a harder "pull" when rolling high density and low density web materials into a high density roll. This "pull" (tension) can provide for a Poisson lateral contraction of the web material resulting in a non-uniformly wound product. Additionally, the application of tension to a perforated web material can cause the web material to rupture at a perforation during processing. This can cause a processing line to shut down.

It is clear that the prior art lacks a winder or a rewinder capable of performing both center winding and surface winding in order to take advantage of the positive attributes that both processes enjoy. For example, it would be desirable to provide a winder that is capable of allowing a broader range of finished product roll densities. As would be appreciated by one of skill in the art, this capability, when coupled with known capabilities for imparting perforations at desired intervals and sheet counts in increments of one, can provide for a greatly enhanced product converting flexibility. This, in turn, can allow multiple finished product designs to be achieved using a common substrate. This is believed to provide substantial manufacturing expense savings by reducing changeovers on paper machines and converting lines, thereby avoiding multiple parent roll inventories and the like. Such a desired hybrid winding system can also provide the capability to wind thick, highly embossed web materials into preferred high density finished product rolls having low sheet tension. As would be appreciated by one of skill in the art, this can improve product quality by eliminating sheet elongation and embossment distortion, as well as improving winding reliability by providing fewer web material feed breaks in the winding process.

SUMMARY OF THE INVENTION

The present invention provides for a method for rewinding a web material. The method comprises the steps of: (1) Disposing the web material on a winding spindle, the winding spindle being operatively associated with a winding turret; (2) Cooperatively engaging a contact roll with the winding spindle when the web material is disposed therebetween, the contact roll being operatively associated with the winding turret; and, (3) Adjusting the position of the contact roll upon said winding turret relative to the winding spindle as the web material is being disposed upon the winding spindle.

BRIEF DESCRIPTION OF THE DRAWINGS

FIG. 1A is an expanded view of the region labeled 1A in FIG. 1;

DETAILED DESCRIPTION OF THE INVENTION

In the prior art, a winder or reel is typically known as a device that performs the very first wind of that web material generally forming what is known as a parent roll. A rewinder, on the other hand, is generally known as a device that winds the web material from the parent roll into a roll that is essentially the finished product. For purposes of the present application, the words "winder" and "rewinder" are interchangeable with one another in assessing the scope of the present claims.

The terms machine direction, cross-machine direction, and Z-direction are generally relative to the direction of travel of a web material or interleaved web segments. The machine direction (MD) is known to those of skill in the art as the direction of travel of the web material or interleaved web segment. The cross-machine direction (CD) is orthogonal and co-planar thereto. The Z-direction is orthogonal to both the machine and cross-machine directions.

Figure 1:
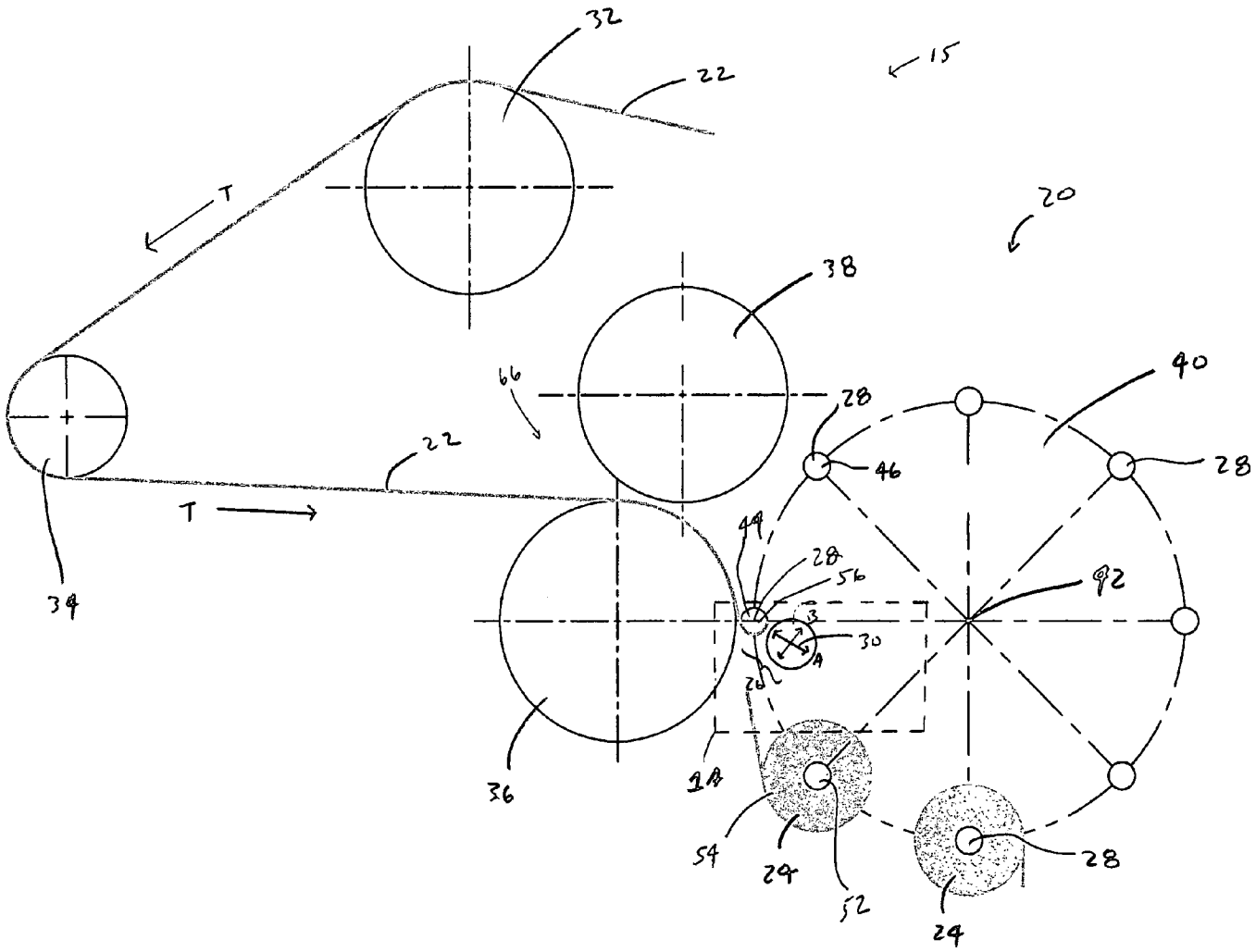
FIG. 1 is a cross-sectional view of an exemplary web winding system and winder at about 0 machine degrees in accordance with the present invention.

Referring now to the drawings, FIG. 1 shows an exemplary web winding system 15 incorporating the new winder 20 of the instant invention. An exemplary but non-limiting web winding system 15 provides for the processing of a web material or interleaved web segments (web material) 22 into a finally wound product 24. The exemplary, but non-limiting, web winding system 15 can comprise a perforation roll 32, a web slitter roll 34, a bed roll 36, and a chop-off roll 38. The perforation roll 32, web slitter roll 34, bed roll 36, and chop-off roll 38 are each provided with a longitudinal axis that is generally parallel to the CD of the web material 22. Such placement can allow for the sequential and/or concurrent processing of web material 22 into a finally wound product 24.

The perforation roll 32 preferably perforates web material 22 upstream of the winder 20. The web slitter roll 34 can provide for the machine direction slitting of web material 22 into two or more portions. The resulting portions of slit web material 22 can then be processed separately or concurrently by either the same or a plurality of web processing systems as would be known to one of skill in the art.

In the exemplary web winding system, as web material 22 travels in direction T, the web material 22 is preferably routed around a portion of the circumference of a bed roll 36 and through a gap disposed between the bed roll 36 and chop-off roll 38. In a preferred embodiment, the bed roll 36 and chop-off roll 38 are concurrently rotated. In a preferred embodiment, chop-off roll 38 is provided with a plurality of blades. Preferably, the bed roll 36 is provided with a plurality of blades that mesh with the blades disposed upon chop-off roll 38 in the gap disposed between bed roll 36 and chop-off roll 38. In an exemplary but non-limiting embodiment, the web material 22 is constrained to a path defined by the blades disposed upon each of bed roll 36 and chop-off roll 38. Applicants believe the web material 22 to be stretched by the relative blade movement and subsequent failure at a line of weakness disposed upon, or within, web material 22 by perforation roll 32.

As would be known to one of skill in the art, after the web material fails at a line of weakness disposed upon, or within, web material 22 by perforation roll 32, the downstream portion of the web material 22 proceeds through the converting process as the tail of the last separated portion of web material 22. This web material portion is then wound into a roll forming finally wound product 24. The upstream portion of the separated web material 22 provides for the leading edge of the web material 22 yet to be processed.

Referring again to the drawings, FIGS. 1 and 1A depict a cross-sectional view of an exemplary web winding system 15 and winder 20 in accordance with the present invention. The winder 20 is suitable for use in winding a web material 22 to produce the finally wound product 24. The finally wound product 24 that may be produced by the winder 20 of the present invention can be any number of types of products, such as hand towels, toilet tissue, paper towels, polymeric films, trash bags, and the like. As such, web material 22 can comprise continuous web materials, discontinuous web materials comprising interleaved web segments, combinations thereof, and the like. Exemplary materials suitable for web material 22 of the present invention include, without limitation, metal foils, such as aluminum foil, wax paper, grease-proof paper, polymeric films, non-woven webs, fabrics, paper, combinations thereof, and the like. The web material 22 is depicted as being transported by the web winding system 15 and the winder 20 in the direction indicated by the arrow T. The web winding system 15 transports the web material 22 into contacting engagement with at least a pair of cooperative rollers 26. Cooperative rollers 26 generally comprise a winding spindle 28 and a contact roll 30, also disclosed herein as pressure roll 30.

The web material 22 can be transported and/or assisted by the exemplary web winding system 15 into winding contact with at least one winding spindle 28. In a preferred embodiment, a plurality of winding spindles 28 are disposed upon a winding turret 40 indexable about a center shaft, thereby defining winding turret axis of rotation 42. The winding turret 40 is preferably indexable or movable about winding turret axis of rotation 42 through an endless series of index positions. For example, a first winding spindle 44 can be located in what may conveniently be called an initial transfer position, and a second winding spindle 46 can be located in what may conveniently be called a final wind position. In any regard, the winding turret 40 is indexable about winding turret axis of rotation 42 from a first index position to a second index position. Thus, the first winding spindle 44 is moved from the initial transfer position into the final wind position. Such indexable movement of the first winding spindle 44 disposed upon winding turret 40 about winding turret axis of rotation 42 may comprise a plurality of discrete, defined positions or a continuous, non-discrete sequence of positions. However, it should be appreciated that contact roll 30 can be brought into proximate contact with winding spindle 28 by any means known to one of skill in the art. Exemplary but non-limiting turrets suitable for use with the present invention (including "continuous motion" turrets) are disclosed in U.S. Pat. Nos. 5,660,350; 5,667,162; 5,690,297; 5,732,901; 5,810,282; 5,899,404; 5,913,490; 6,142,407; and 6,354,530. As will also be appreciated by one of skill in the art, the so-called "open-loop" turret systems would also be suitable for use as a support for the disposition and movement of winding spindles 28 used in accordance with the present invention. An exemplary, but non-limiting, "open-loop" turret system is disclosed in International Publication No. WO 03/074398.

If so desired by the practitioner, the contact roll 30 of the present invention may be provided with a relieved surface. In such an embodiment, the relieved portions can be provided as a pattern disposed upon or within the material comprising contact roll 30. Such a pattern may be disposed upon or otherwise associated with contact roll 30 by laser engraving, mechanical implantation, polymeric curing, or the like. In an exemplary but non-limiting embodiment, such a pattern, relief, or otherwise may correspond to any indicia, embossments, topography pattern, adhesive, combinations thereof, and the like that are disposed upon or disposed within web material 22. It is believed that such an exemplary pattern associated with a contact roll 30 may be registered with respect to any direction or directions of the web material 22, particularly the machine and/or cross-machine directions of web material 22. Such a pattern can be associated with a contact roll 30 and can be provided relative to any indicia, embossments, topography pattern, combinations thereof, or the like associated with web material 22 by any means known to one of skill in the art. Such an embodiment may be useful in preserving desirable features in the web material 22, such as embossments, or may provide a desired contact force, such as for improved bonding force in discrete and/or desired areas of a two-ply or other multiple-ply product comprising adhesive for joining one ply to another. Similarly, the contact roll 30 can be provided with embossments and/or any other type of topographical pattern corresponding to the portions of a multi-ply type of web material 22 that may have an adhesive or other bonding formulation or structure disposed between the plies forming such a web material 22 structure. A contact roll 30 provided with such embossments and/or any other type of topographical disposed thereon can provide for better adhesion and/or bonding of the plies forming a multi-ply web material 22 by providing additional pressure to the regions sought to be so bonded as would be known to one of skill in the art. Without desiring to be bound by theory, it is believed that such increased bonding can be useful for the prevention of so-called "skinned" rolls when the plies of the multiple ply finally wound product 24 separate during dispensing by the consumer. This is known to those of skill in the art as an undesirable quality defect.

In a preferred embodiment of the present invention, the contact roll 30 is driven at a surface speed that corresponds to the speed of the incoming web material 22. A positioning device (not shown), such as linear actuators, servo motors, cams, links, and the like, known by those of skill in the art as useful to provide such a result, can be provided for control of the position of the longitudinal axis of contact roll 30 relative to the longitudinal axis of a given winding spindle 28. Such a positioning device (not shown) associated with a contact roll 30 is preferably capable of moving the contact roll 30 in any direction, including, but not limited to, the machine direction, the cross-machine direction, the Z-direction, or any combination thereof. In a preferred embodiment, the movement of contact roll 30 is generally parallel to the Z-direction relative to web material 22, as the web material 22 is in contacting engagement with a winding spindle 28. It is believed that in this way the position of the contact roll 30, when combined with the known diameter growth of the log associated with first winding spindle 44, can provide the required contact, clearance, and/or pressure between the contact roll and the log associated with first winding spindle 44 having web material 22 being disposed thereon. However, it should be realized that the contact roll 30 can be provided with movement with respect to any direction relative to its longitudinal axis in virtually any direction required to provide the required contact or clearance between the contact roll 30 and the log associated with first winding spindle 44. Likewise, the contact roll 30 can have virtually any numbers of axes (i.e., at least one) associated thereto, as required, in order to provide the required contact or clearance between the contact roll 30 and the log associated with first winding spindle 44 as web material 22 passes therebetween.

If contact between the contact roll 30 through web material 22 to the log associated with first winding spindle 44 is desired, the position of a respective contact roll 30 along an exemplary axis A and/or B can be controlled to a known position in order to provide the desired contact or clearance between the respective contact roll 30 and the respective log associated with the first winding spindle 44 throughout the entire wind, if required. Maintaining a desired contact or clearance throughout the entire wind may be particularly advantageous when winding products having higher densities. Maintaining contact throughout the wind in such an instance is believed to facilitate compaction of all layers of web material 22 within the finally wound product 24, thereby providing maximum potential density. Maintaining contact throughout the entire wind is also believed to provide product consistency when the web material 22 comprises a structure that is affected by contact force against the contact roll 30. By way of example, embossed areas disposed upon a web material 22 may have a different appearance or thickness in a region contacted by the contact roll 30 compared to an area of contact roll 30 not so contacted.

Alternatively, the position of contact roll 30 can be positioned along any of exemplary axes A, B, or any other desired axes, respectively, in order to regulate the contact force between the contact roll 30 and the respective log associated with either of first or second winding spindles 44, 46. By way of example, in order to provide a low density product roll design upon a finally wound product 24, there may be minimal or even no contact between the respective contact roll 30 and the log associated with first winding spindle 44. For medium density product roll designs in a finally wound product 24, there may be moderate contact or force between the respective contact roll 30 and the log associated with first winding spindle 44. For providing high density product roll designs in a finally wound product 24, there may be relatively high contact or force between the respective contact roll 30 and the log associated with first winding spindle 44. In any regard, it is preferred that the rotational speed of the winding spindles 28 be controlled in order to decelerate at a rate that maintains the same winding surface speed or desired speed differential as the diameter of the log associated with first winding spindle 44 increases.

Alternatively, the product density of a finally wound product 24 can be adjusted by adjusting the surface speed of the contact roll 30 and/or the surface speed of the respective log associated with first winding spindle 44. Without desiring to be bound by theory, it is believed that providing such a speed differential between the surface speed of the contact roll 30 and/or the surface speed of the log associated with first winding spindle 44 can vary the tension present in the web material 22 forming finally wound product 24. By way of non-limiting example, in order to provide a low density finally wound product 24, there may be a minimal or even no speed differential between the surface speed of the contact roll 30 and/or the surface speed of the log associated with first winding spindle 44. However, if a high density finally wound product 24 is desired, there may be relatively high speed differential or bias between the surface speed of the contact roll and/or the surface speed of the log associated with first winding spindle 44. In any regard, the surface speeds of the contact roll 30 and/or the log associated with first winding spindle 44 can be controlled jointly or severally in order to provide a finally wound product 24 having the desired wind profile.

As shown in FIG. 1, the winder 20 preferably provides a turret 40 supporting a plurality of winding spindles 28 and contact roll 30. The winding spindles 28 preferably engage a core (not shown) upon which the web material 22 is wound. The winding spindles 18 are preferably driven in a closed spindle path about the winding turret 40 axis of rotation 42. Each winding spindle 28 extends along a winding spindle 28 axis generally parallel to the winding turret 40 axis of rotation 42 from a first winding spindle 28 and to a second winding spindle 28 end. The winding spindles 28 are preferably supported at their first ends by the winding turret 40 assembly. The winding spindles 18 are preferably releasably supported at their second ends by a mandrel cupping assembly (not shown). The winding turret 40 preferably supports at least two winding spindles 28; more preferably at least six winding spindles 28 and in one embodiment the turret assembly 42 supports at least eight winding spindles 28. As would be known to one of skill in the art, a winding turret assembly 40 supporting at least eight winding spindles 28 can have a rotatably driven winding turret 40 that is rotated at a relatively low and preferably generally constant angular velocity to reduce vibration and inertial loads while providing increased throughput relative to indexing a winding turret 40 which is intermittently rotated at higher angular velocities. Exemplary winding turret assemblies suitable for use with the present invention are disclosed in U.S. Pat. Nos. 5,690,297 and 5,913,490.

A perforation roll 32, anvil, or other non-contact perforation device known to those of skill in the art can be adapted to provide lines of perforations extending along the cross-machine direction of the web material 22. Adjacent lines of perforations are preferably spaced apart at a predetermined distance along the length of the web material 22 to provide individual sheets of web material 22 that are joined together at the perforations. The sheet length of the individual sheets of web material 22 is the distance between adjacent lines of perforations.

Once the desired number of sheets of web material 22 has been wound onto a log associated with first winding spindle 44 in accordance with the present invention, a web separator 66 can be utilized in order to provide separation of adjacent sheets of perforated web material 22. In the preferred embodiment, as discussed supra, the web separator 66 is provided as a rotary unit comprising a bed roll 36 and chop-off roll 38 that cooperatively engage web material 22 in a position intermediate to bed roll 36 and chop-off roll 38. In such a preferred embodiment, the web separator 66 intermittently and/or periodically contactingly engages the web material 22 disposed therebetween. The elements comprising such a semi-continuous web separator 66, either individually or collectively, can be provided with momentary periods of acceleration or deceleration. As such, the surfaces comprising the bed roll 36 and chop-off roll 38 preferably move along a circular path which has an axis coincident with the axis of rotation. Each element of the web separator 66 is almost tangent to, or makes a slight interference with, the surface of the opposing element of the web separator 66.

Once the desired number of sheets of web material 22 have been wound onto the log associated with first winding spindle 44, the web separator 66 is moved (i.e., preferably rotated) into a position which facilitates the formation of a nip between the opposing elements (i.e., the bed roll 36 and chop-off roll 38) associated with the web separator 66. Such a nip may comprise the surfaces of the bed roll 36 and chop-off roll 38 having aforementioned blades as well as rollers, pressers, or pads cooperatively associated with the bed roll 36 and chop-off roll 38 associated with the web separator 66. The movement of the bed roll 36 and chop-off roll 38 comprising the web separator 66 is preferably timed so that the web separator 66 nips the web material 22 disposed between the bed roll 36 and chop-off roll 38 when the perforation at the trailing end of the last desired sheet for the log associated with first winding spindle 44 is located between the bed roll 36 and chop-off roll 38 comprising the web separator 66.

The web material 22 disposed upstream of the nip formed between the bed roll 36 and chop-off roll 38 comprising web separator 66 is then transferred to a new winding spindle 18 which has had an adhesive disposed thereon to form second winding spindle 46. In a preferred embodiment, a core is disposed upon the new winding spindle 18 that forms second winding spindle 46 and is held securely thereto. The winding turret 40, comprising the winding spindles 18, moves the first winding spindle 44 to the finish wind position, either intermittently or continuously, and the winding cycle is repeated. After the wind has been completed, the finally wound product 24 is removed from the first winding spindle 44 disposed upon turret 40 and a new core is preferably disposed upon the now vacant winding spindle 18. Adhesive can then be applied to the new core prior to the web material 22 transfer. The winding sequence is then repeated as required.

As described previously, a preferred embodiment of the present invention includes winding the web material 22 on hollow cores for easy roll mounting and dispensing by the consumer. Additionally, the winder 20 of the instant invention provides for adjustable sheet length capability in order to provide format flexibility and sheet count control in increments of one for such format flexibility.

Further, one of skill in the art could provide the winding spindles 18 and/or contact rolls 30 with a speed profile that can allow for an enhanced winding capability. Such enhanced winding capability may be useful or even preferable for low density substrates. Additionally, disposing web material 22 between the first winding spindle 44 and a corresponding and engaged contact roll 30 forming cooperative rollers 26 can provide for an adjustable contact position and/or force upon winding spindle 28 and the web material 22 at the periphery of the log associated with first winding spindle 44. Providing first winding spindle 44 with an adjustable rotational speed can provide for the ability to apply a force at a point after the web material 22 is disposed upon first winding spindle 44. This process can provide for a finally wound product 24 having the desired wind profile.

For example, finally wound product 24 may be produced as a web material 22 having a perforated sheet length of 250 mm, a 100-sheet count, a finished roll diameter of 130 mm, and be wound upon a core having an outer diameter of 40 mm. Using this information, the theoretical average radial thickness for each layer of web material 22 comprising finally wound product 24 can be calculated to be about 480 μm. In such an exemplary embodiment, the web material 22 may be provided with an initial (i.e., untensioned thickness of 750 μm as web material 22 enters the winding area of winder 20. In order to provide for the above-described finally wound product 24, if no contact exists between the log associated with a winding spindle 28 and the corresponding contact roll 30, the web material 22 must be compressed from the initial thickness of 750 μm to the required theoretical target thickness of 480 μm by only the tension exerted by the winding spindle 28 speed on the incoming web material 22. Without desiring to be bound by theory, the calculated tension required to decrease the thickness of web material 22 from an initial 750 μm thickness to the required 480 μm thickness is about 50 g per linear centimeter. However, one of skill in the art will appreciate that the web material 22 may separate uncontrollably at the perforations disposed within web material 22 when web material 22 is subject to such a tension (i.e., nominally greater than 350 g per linear centimeter). Such uncontrolled separations can produce an unacceptable finally wound product 24 and potentially result in line/production stoppages.

Additionally, the winder 20, as disclosed supra, may be utilized to provide supplemental compression of the web material 22 being wound upon a winding spindle 28 to produce finally wound product 24. For example, a contact roll 30 may be loaded against the log associated with the corresponding winding spindle 18 by moving the position of the contact roll 30 along exemplary axes A and/or B relative to a winding spindle 18 in order to achieve the desired finally wound product 24. For example, a contact roll 30 may be loaded against a log disposed upon a corresponding winding spindle 28 with a force of 100 g per linear centimeter. By calculation, it is believed that such a force may decrease the thickness of the web material 22 from a thickness of 750 μm to a thickness of 500 μm. The calculated required winding tension to further decrease the thickness of web material 22 from a thickness of 500 μm to the required thickness of 480 μm may be provided with as little as 40 g per linear centimeter. This required tension level is well below the known and assumed perforation separation level of 350 g per linear centimeter, thereby allowing reliable production of the desired finally wound product 24.

Additionally, one of skill in the art will understand that the winder 20 disclosed herein can provide contact with the log associated with the first winding spindle 34 throughout the entirety of a wind cycle. Thus, a finally wound product 24 can be provided with heretofore unrealized winding uniformity throughout the entire finally wound product 24. Further, one of skill in the art will realize that providing winding spindles 28 in a turret system 40 moving in a closed path can provide for continuous winding and removal of finally wound product 24 without the need to interrupt the turret system 40 to load and unload winding spindles 28 or even the cores disposed upon winding spindles 28 from a moving turret system 40 mechanism.

PROCESS

As used herein, a "machine degree" is equivalent to 1/360 of a complete cycle. With regard to the winder 20 described herein, the 360 machine degrees is defined as a complete rewind cycle; that is, from a first identified index position (such as an initial transfer position or a final wind position) to the next identical and succeeding index position (such as the subsequent or second identical initial transfer position or the subsequent or second identical final wind position).

Referring to FIGS. 1 and 1A, the winder 20 of the present invention is shown at about 0 machine degrees. The web material 22 disposed between first winding spindle 44/contact roll 30 and third winding spindle 52 has been separated at an identified perforation by the web separator 66 comprising bed roll 36 and chop-off roll 38. In a preferred embodiment, the bed roll 36 and chop-off roll 38 comprising the web separator 66 are surface speed matched with web material 22. In such an embodiment, at least one of the bed roll 36 and chop-off roll 38 are provided with at least one blade that is interdigitating and/or nestably related with a corresponding depression, groove, and/or blade, retractable or otherwise, disposed upon the second of the bed roll 36 and chop-off roll 38 comprising the web separator 66. It is believed that such interdigitating and/or nestable blade assemblies known by those of skill in the art can be adapted to provide such a surface speed matched web separator 66 assembly. By way of non-limiting example, the assemblies discussed in U.S. Pat. Nos. 4,919,351 and 5,335,869 can be adapted to provide such a surface speed matched web separator 66 assembly suitable for use with the present invention.

Concurrent with the separation of web material 22 at the identified perforation, the contact roll 30 is movable along an exemplary axis A, as well as a machine direction axis B. In a preferred embodiment, each winding spindle 18 is provided with a core having an adhesive disposed upon the surface thereof to facilitate attachment of the leading edge of the web material 22 to the respective winding spindle 28. Further, the remaining web material 22 attached to winding spindle 28 forming old log 54 continues to be disposed thereon. It should be realized that contact roll 30 supporting web material 22 can be movable about one or a plurality of exemplary axis (shown as A and B) in order to provide for a desired pressure to be exerted upon new log 56 having web material 22 disposed thereon. It is in this manner that old log 54 and new log 56 can be provided with a desired wind profile during the entirety of the winding process.

It should be realized that the position and/or loading force of the contact roll 30 upon any winding spindle 18 can be adjusted such that contact roll 30 maintains the desired contact force or position relative to the winding spindle 18 at all points during the winding cycle. Additionally, the contact roll 30 is initially driven at a surface speed that corresponds to the speed of the incoming web material 22 and the surface speed of the first winding spindle 44. In a non-limiting embodiment, positioning devices, such as linear actuators, can control the position of the contact roll 30. In any regard, the position of the contact roll 30, combined with the known diameter growth of the desired winding log, can determine the contact or clearance between the contact roll 30 and the winding log. If contact is desired, such contact may be controlled to a known position or interference or, alternatively, by regulating the contact force between the contact roll and each respective winding logs 52, 54. By way of non-limiting example, if low density product roll designs are desired, there may be no contact between contact roll 30 and the respective winding logs 54, 56. By further example, if medium density product roll designs are desired, there may be moderate contact or force between the contact roll 30 and the respective winding logs 54, 56. Yet further, if high density product roll designs are desired, there may be relatively high contact or force provided between the contact roll 30 and the respective winding logs 54, 56.

In any regard, it is preferred that the contact roll 30 provided herein contact the respective winding logs 54, 56 at a point other than the tangent point of the incoming web material 22. In all cases, the rotational speed of the winding spindle 28 is controlled to decelerate at a rate that maintains the same winding surface speed or desired differential as the winding log diameter increases. It is believed that such profiled mandrel drive systems are well known to those of skill in the art.

Figure 2A:
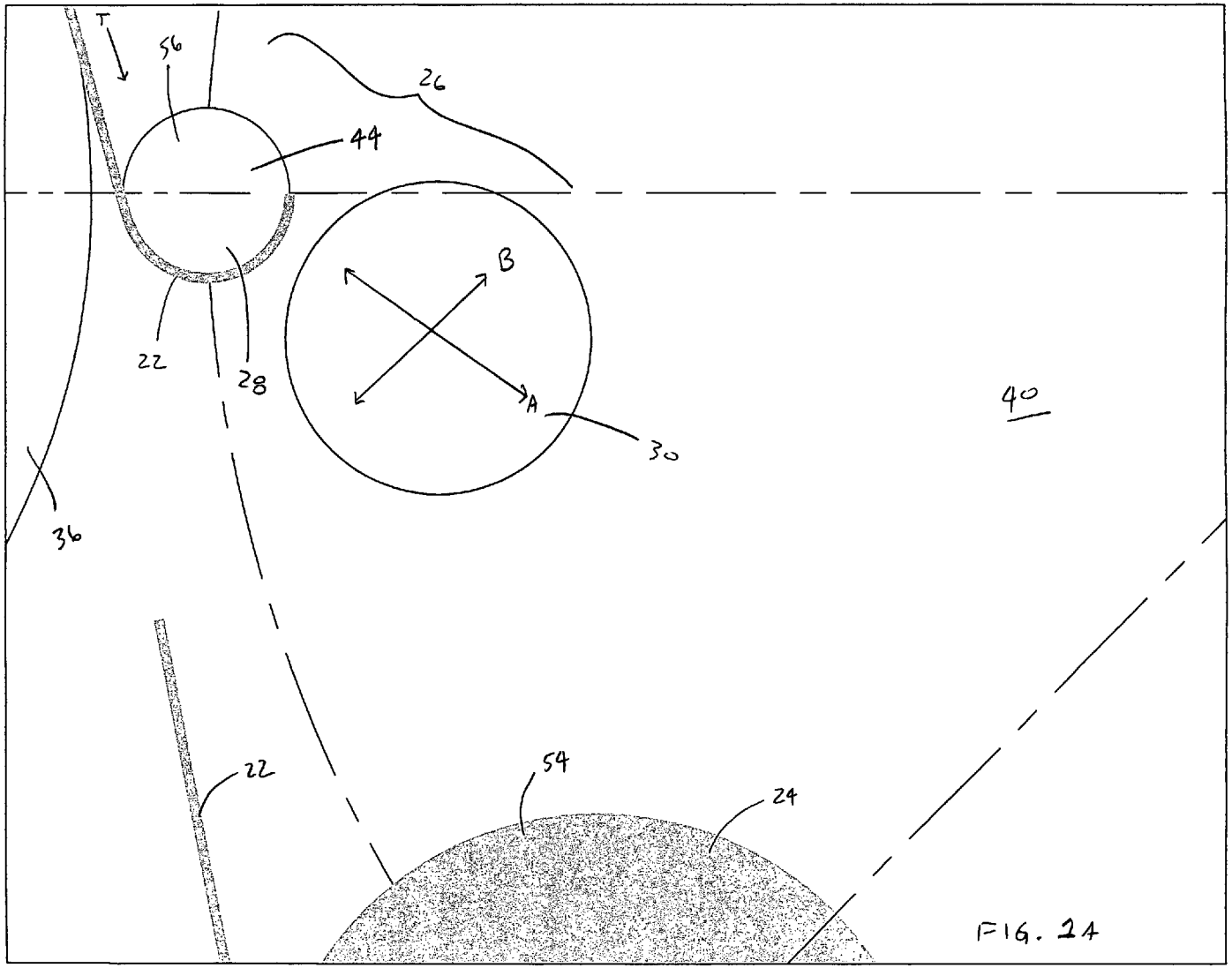
FIG. 2A is an expanded view of the region labeled 2A in FIG. 2.
Figure 2:
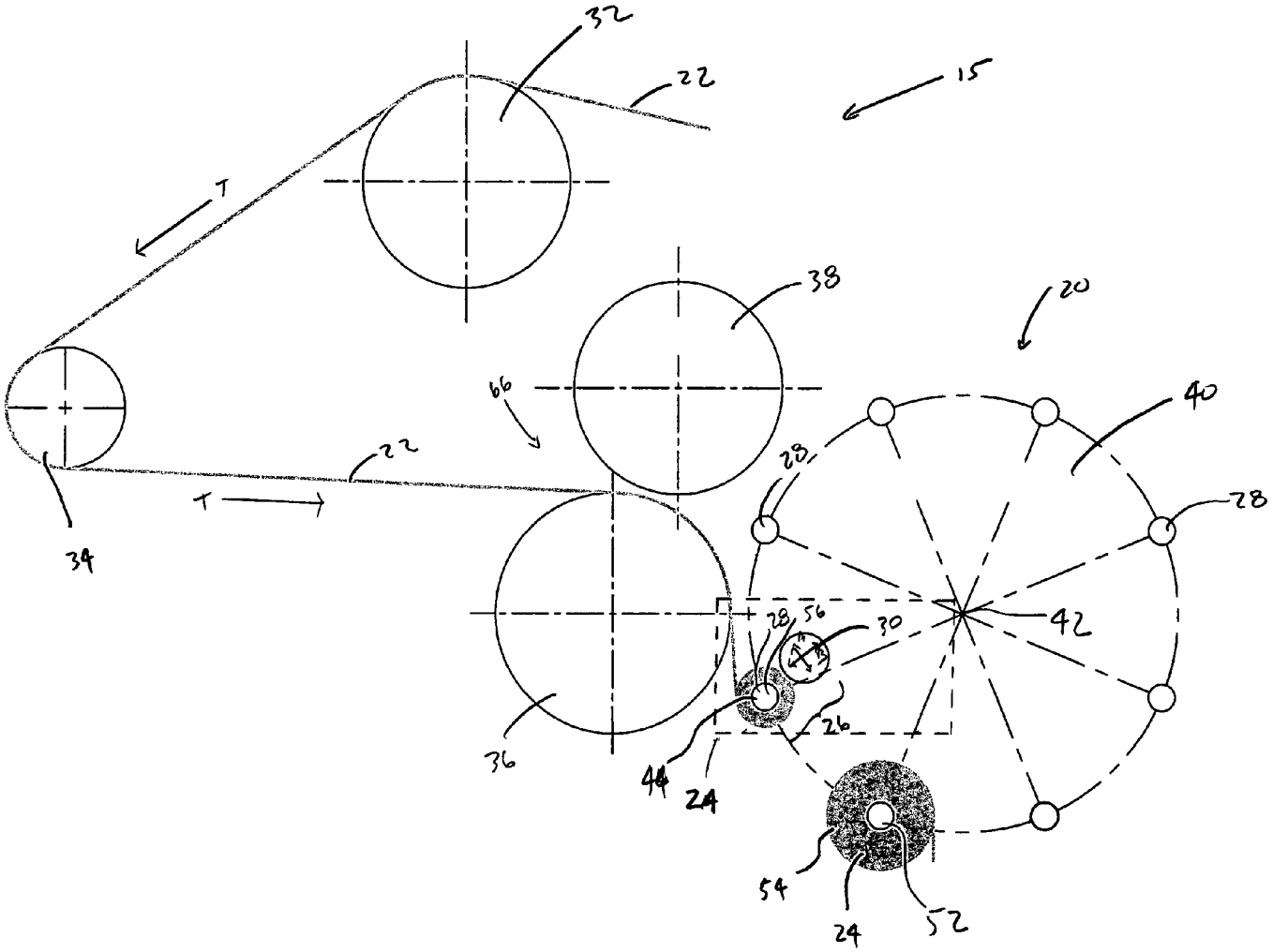
FIG. 2 is a cross-sectional view of the exemplary web winding system and winder shown in FIG. 1 at about 90 machine degrees.
Figure 24:
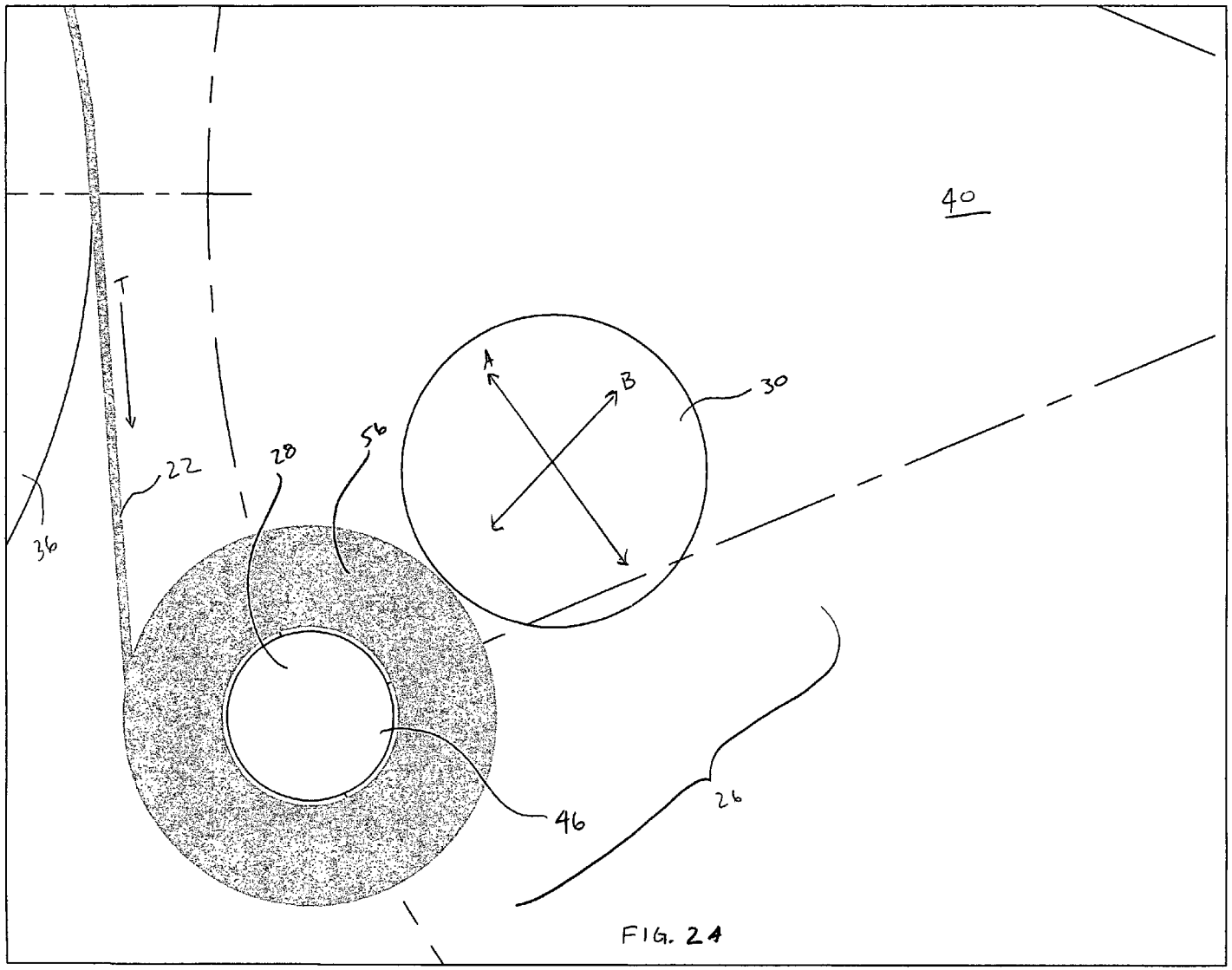

FIG. 2 depicts the web winding system 15 and winder 20 of the present invention at about 90 machine degrees. As shown, as the new log 56 is indexed by the turret 40 from the initial transfer position to the end of wind position, the contact roll 30 is similarly indexed to maintain the desired contact or pressure with the new log 56. Preferably, contact and/or pressure exerted upon the new log 56 by the contact roll 30 is maintained throughout the entirety of the winding cycle. However, as would be known to one of skill in the art and as discussed, supra, contact between the new log 56 and the contact roll 30 can be provided as required in accordance to produce a finally wound product 24 having the characteristics desired. For example, the contact position, pressure, and/or force may be controlled to any desired value from the beginning of the wind cycle to the end of the wind cycle as new log 56 progresses from the initial transfer position to the final wind position. As depicted, web material 22 is being disposed upon the winding spindle 18 to form new log 56 as new log 56 progresses from the first initial contact position to the final log winding position. Concurrent with new log 56 growth upon winding spindle 28, the speed at which winding spindle 28 turns is preferably adjusted to maintain a matched surface speed of new log 56 with incoming web material 22 contacting or disposed upon first winding spindle 44. Additionally, contact roll 30 can be provided with movement along axes A, B, or any other axes so desired in order to provide the desired contact or pressure upon new log 56 as the diameter of new log 56 increases radially due to deposition of web material 22 thereupon. Further, old log 54 can be removed from the turret 40 and a new core, if required, can be disposed upon the winding spindle 18 previously occupied by old log 54 forming finally wound product 24.

Figure 3:
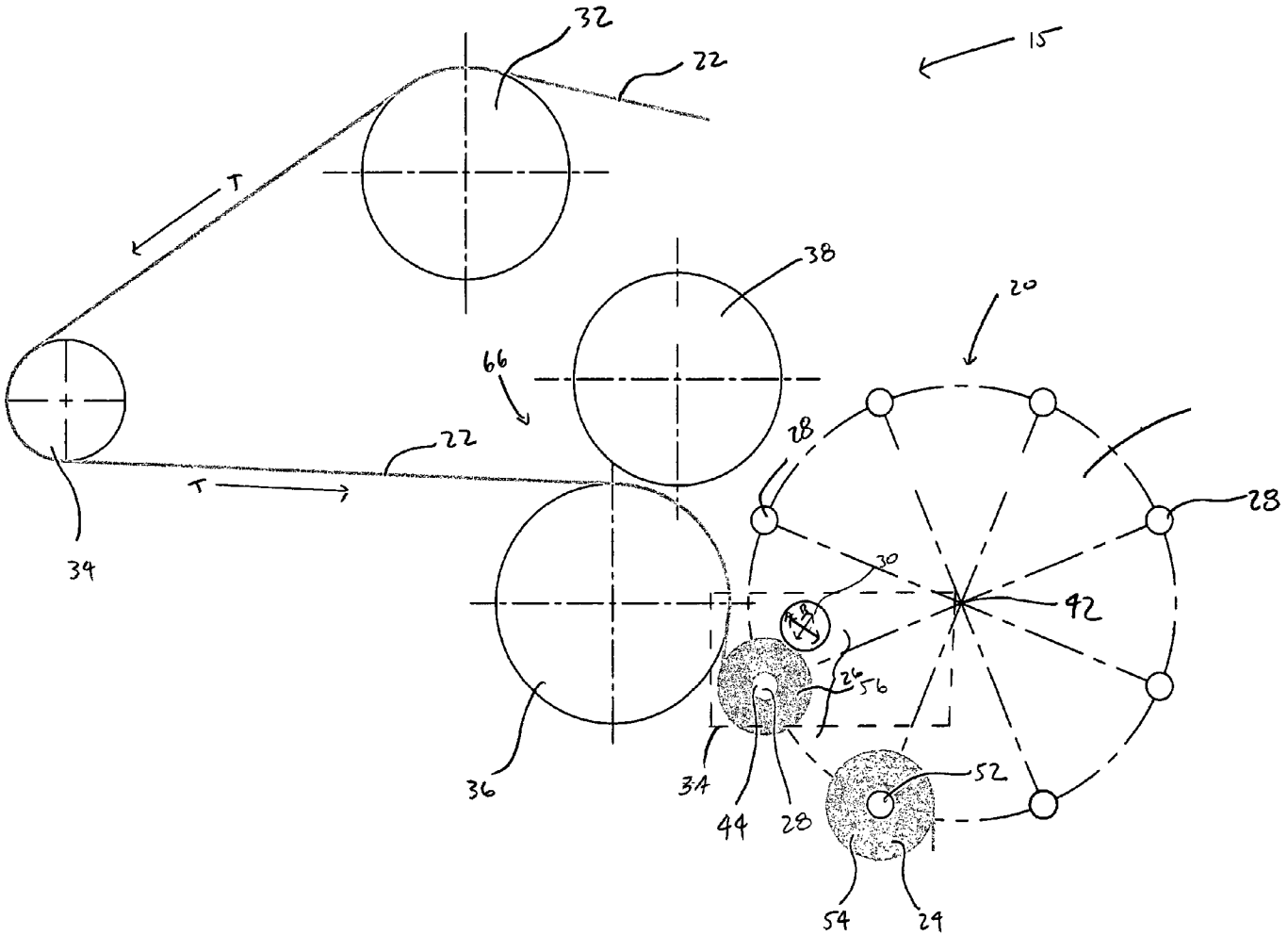
FIG. 3 is a cross-sectional view of the exemplary web winding system and winder shown in FIG. 1 at about 270 machine degrees.
Figure 3A:
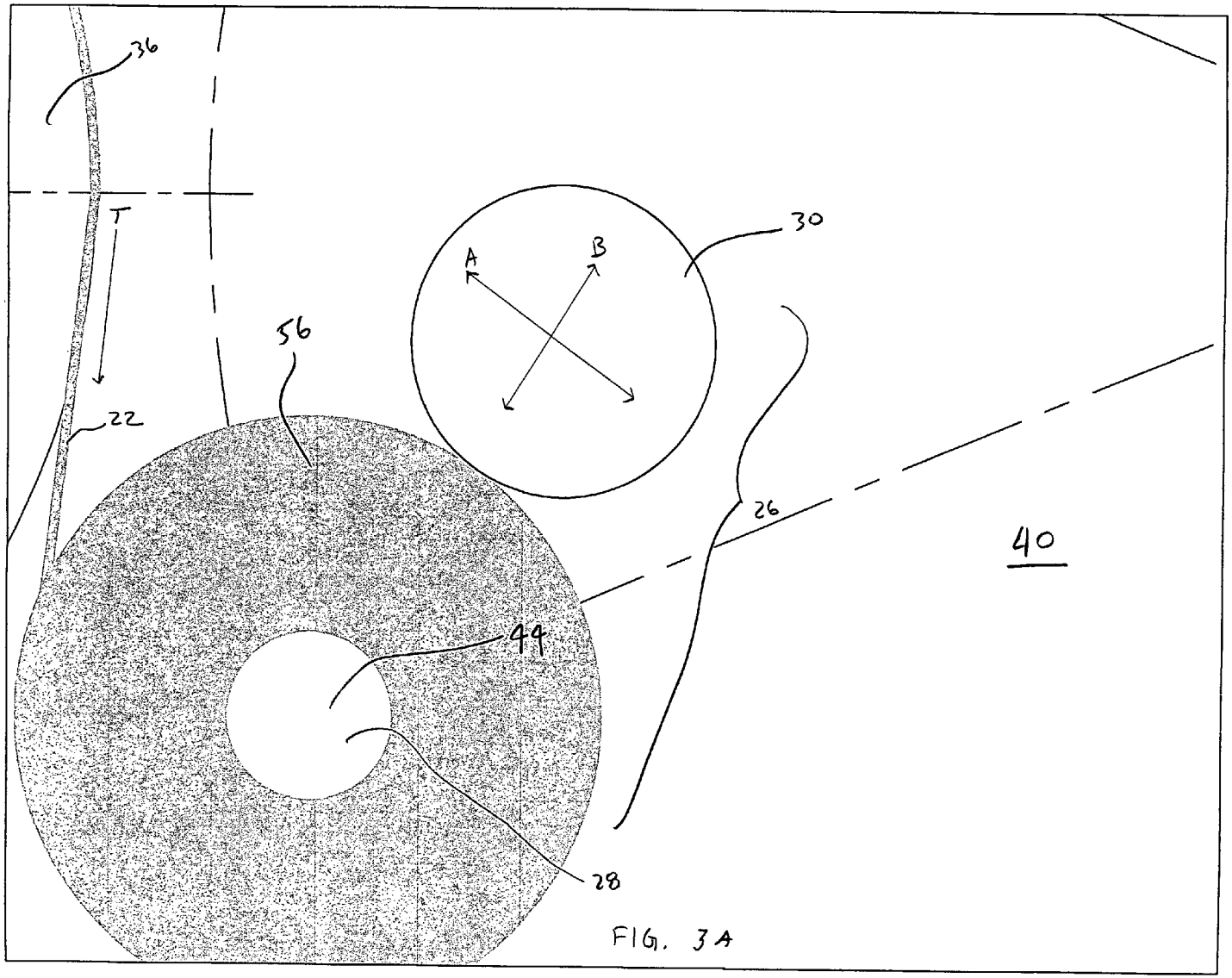
FIG. 3A is an expanded view of the region labeled 3A in FIG. 3.

FIGS. 3 and 3A depict web winding system 15 and winder 20 of the present invention as would be seen at about 270 machine degrees. In this position, the new log 56 continues to display radial growth as web material 22 is rotationally disposed thereupon. It should be realized by one of skill in the art that turret 40 may or may not be indexed between 90 and 270 machine degrees. It is believed that the indexing of turret 40 may be accomplished by those of skill in the art on an as-required basis. Further, as required, the position of contact roll 30 can be adjusted along exemplary axis A, B, or any other axis so desired in order to provide the desired surface pressure upon new log 56 in order to provide for the desired wind profile. As new log 56 progresses orbitally about the turret axis of rotation 42 of turret 40, old log 54, having web material 22 disposed thereupon, can be prepared for removal or removed from the turret 40 as a finally wound product 24.

Figure 4:
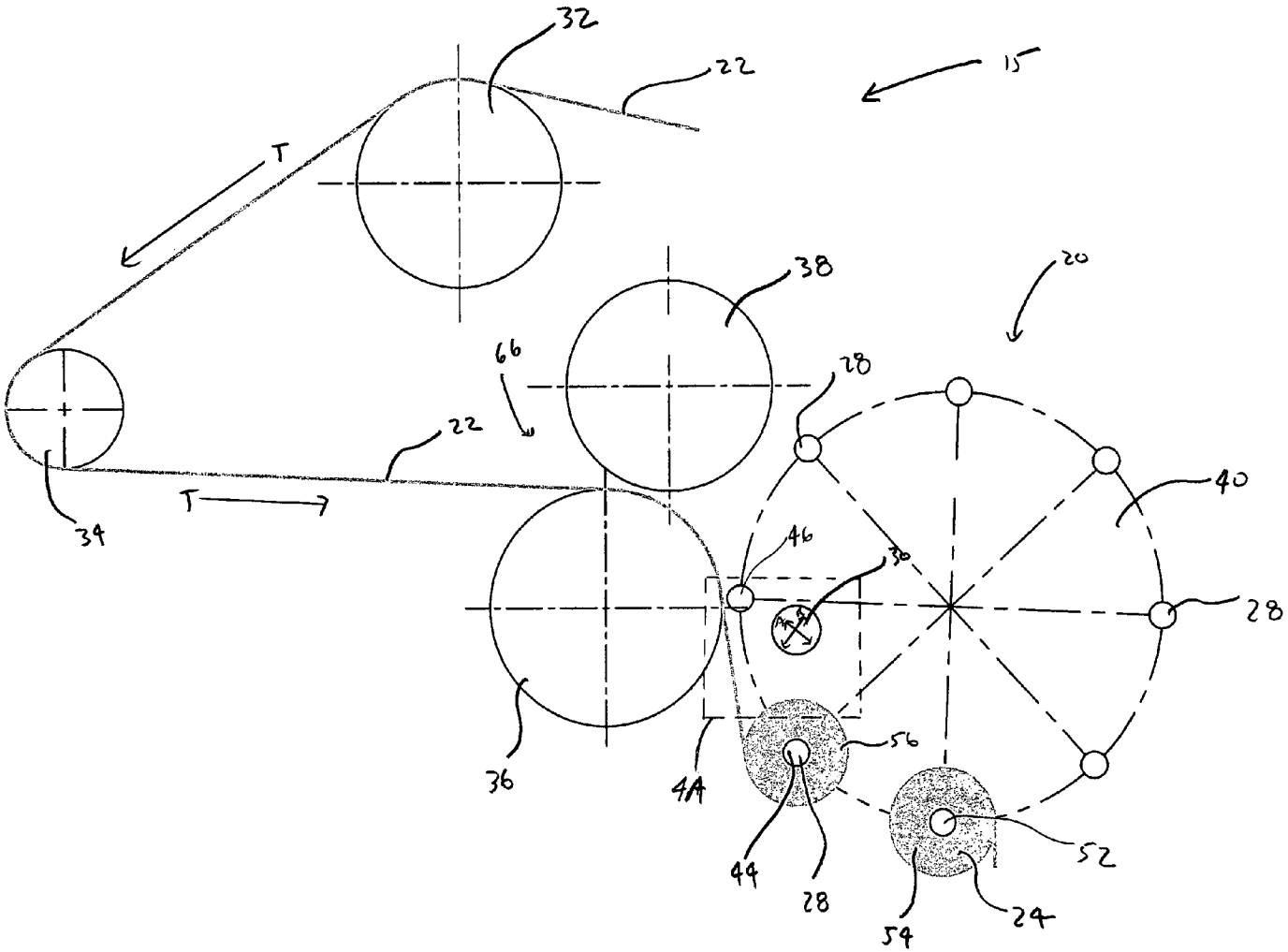
FIG. 4 is a cross-sectional view of the exemplary web winding system and winder shown in FIG. 1 at about 350 machine degrees.
Figure 4A:
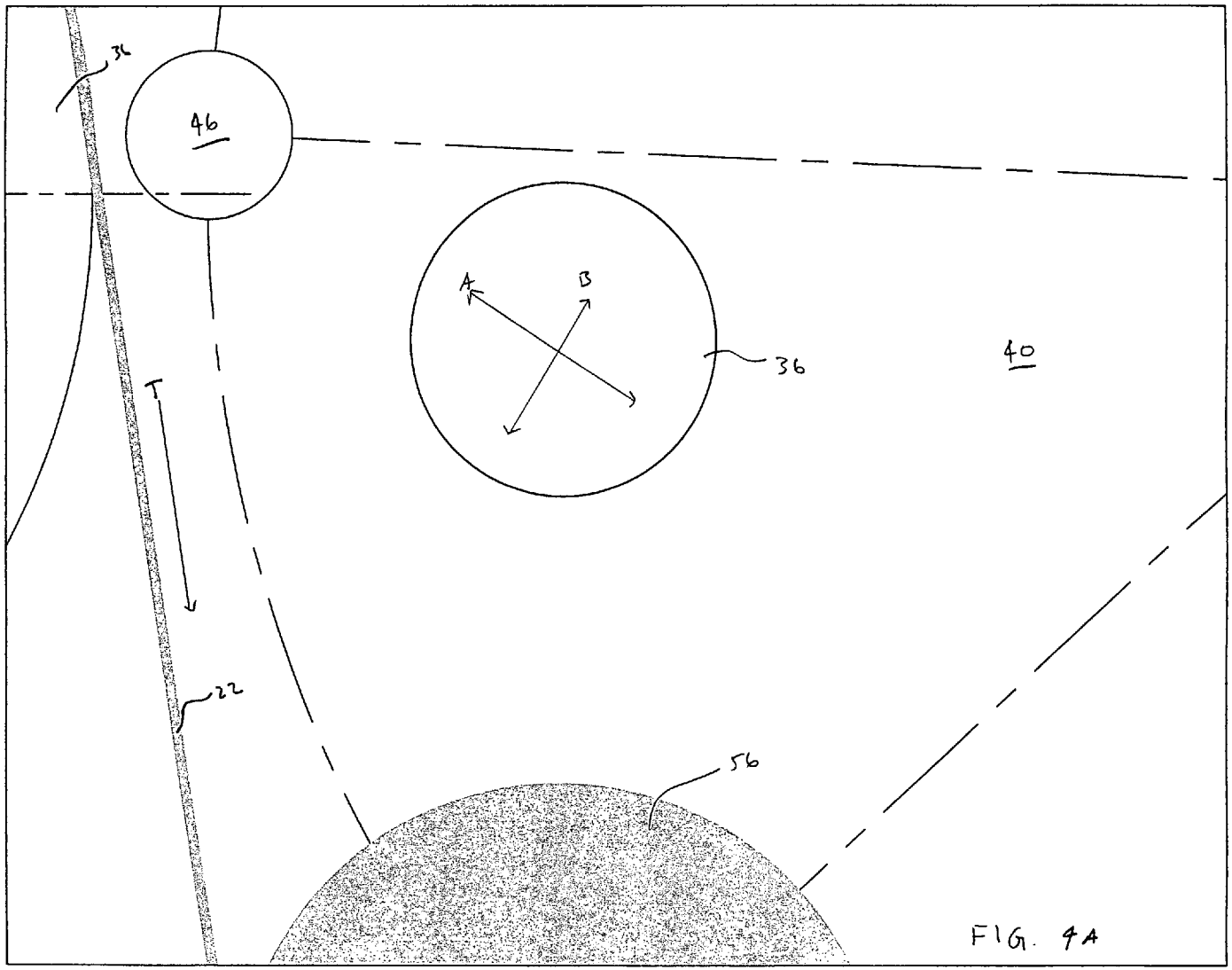
FIG. 4A is an expanded view of the region labeled 4A in FIG. 4.

FIGS. 4 and 4A depict the web winding system 15 and winder 20 of the present invention at about 350 machine degrees. At this point, new log 56 is experiencing radial growth due to the continued deposition of web material 22 thereupon. In a preferred embodiment, the position of contact roll 30 can be adjusted along axes A, B, or any other axes so desired in order to provide the desired contact or pressure of the first contact roll 30 upon new log 56 in order to provide the desired wind profile as the web material 22 is disposed thereupon. However, in an alternative embodiment, the position of contact roll 30 is adjusted in order to provide contactable engagement of the contact roll 30 with the winding spindle 18 that will become second winding spindle 46. This requires contact roll 30 to leave contacting engagement with first winding spindle 44 forming new log 56 and gain contacting engagement, or become proximate to, second winding spindle 46 forming a second new log (not shown). Additionally, the bed roll 36 and chop-off roll 38 forming the web separator 66 are each moved into a position relative to web material 22 in order to facilitate separation of web material 22 at the desired perforation, as described supra.

Figure 5:
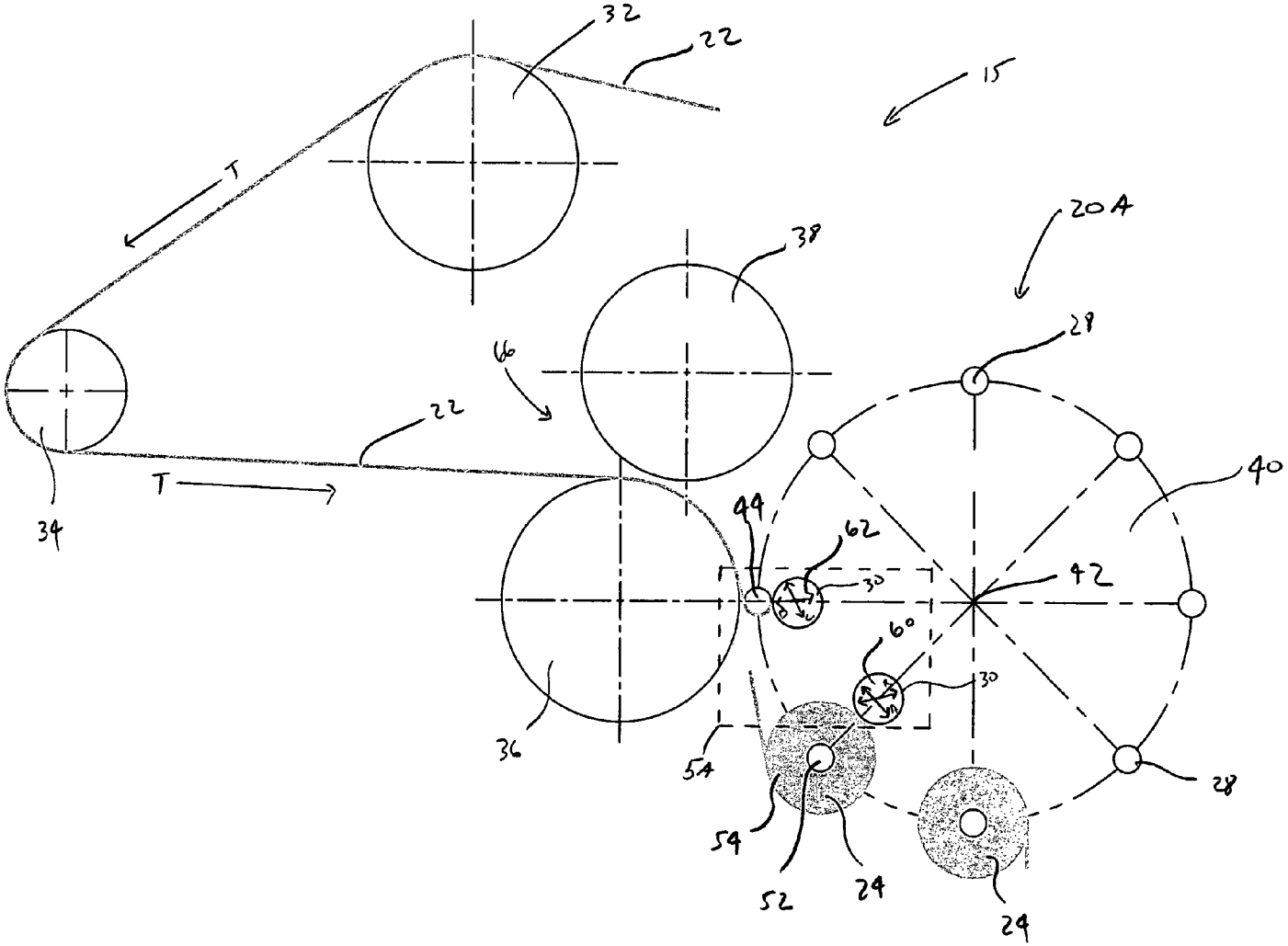
FIG. 5 is a cross-sectional view of an alternative embodiment of the web winding system and winder at about 0 machine degrees.
Figure 5A:
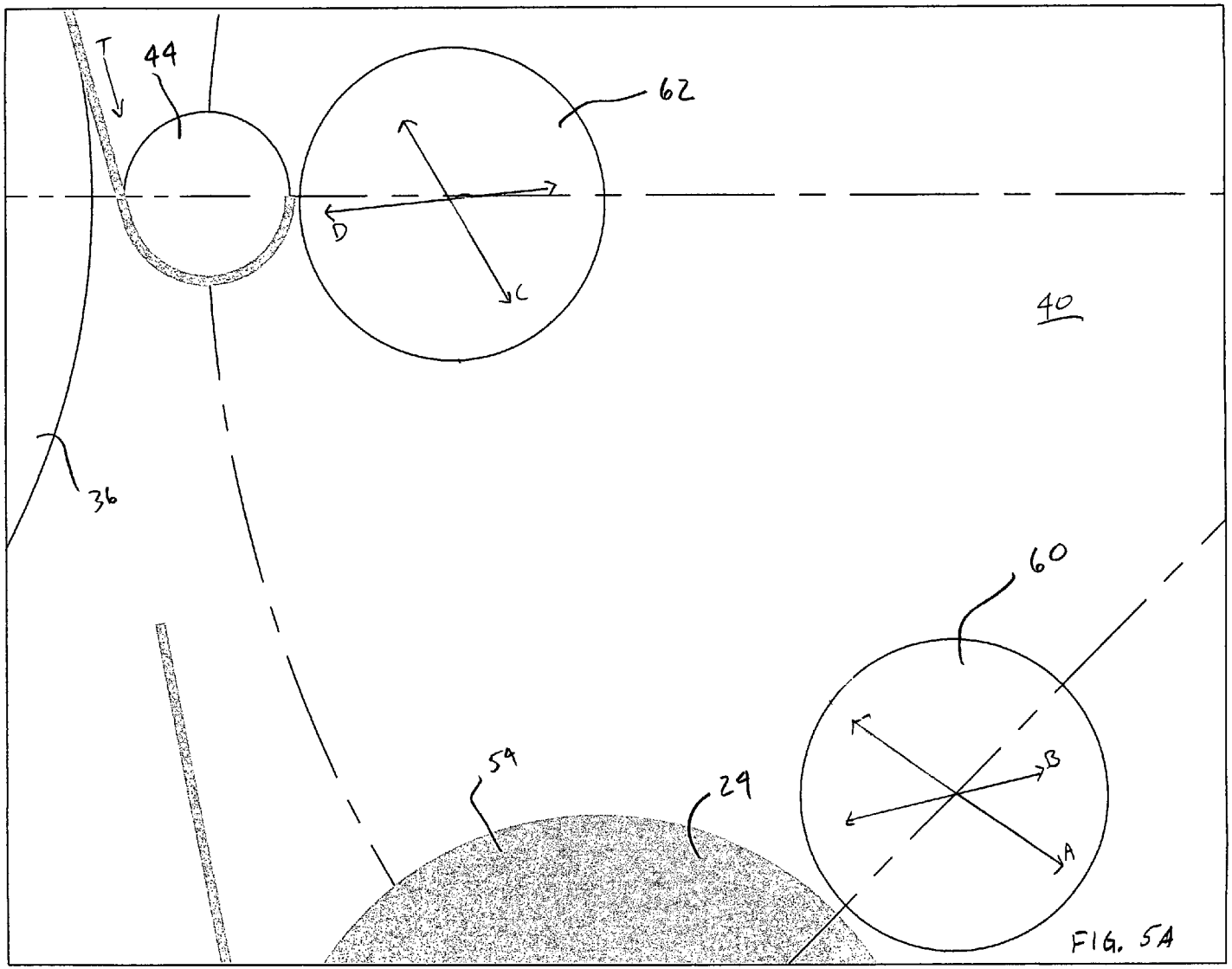
FIG. 5A is an expanded view of the region labeled 5A in FIG. 5.

FIGS. 5 and 5A depict an alternative embodiment of web winding system 15 and the winder 20A of the present invention at approximately 0 machine degrees. Winder 20A provides a turret 40 supporting a plurality of winding spindles 78 and two contact rolls 30. At this point, first winding spindle 44 is beginning initial radial growth due to the deposition of the web material 22 thereupon. The position of the second contact roll 62 can be adjusted along axes A, B, or any other desired axes in order to provide the desired contact or pressure of the second contact roll 62 upon first winding spindle 44 in order to provide the desired wind profile as web material 22 is disposed thereon. Concurrently, first contact roll 60, which is in contacting engagement with third winding spindle 52 forming old log 54, loses contacting engagement with web material 22 disposed upon old log 54 after completion of a wind cycle. In any regard, first contact roll 60 and/or second contact roll 62 are positioned within the turret 40 adjacent to third winding spindle 52 and first winding spindle 44, respectively, as they are used to apply a force or pressure to the respective winding spindle to control the diameter of the respective winding log. As shown in FIGS. 5 and 5A, the two contact rolls 60, 62 are used to ensure that contact is maintained with each winding log throughout the entirety of the winding sequence.

In a preferred embodiment, the position and/or force applied by all contact rolls 30 upon the respective winding spindle 28 is preferably independently adjustable. The position of each contact roll 30 can be adjusted such that each contact roll 30 maintains the desired contact force or position relative to the respective winding log at all points during the winding cycle. To ensure a reliable web transfer to a new core, it is preferred that each contact roll 30 is initially driven at a surface speed that corresponds to the speed of the incoming web and the surface speed of the new core. Positioning devices, such as linear actuators and the like, can control the position of each contact roll 30. The position of each contact roll 30 combined with the known diameter growth of the respective winding log can determine the contact or clearance between each of the respective contact rolls 30 and the respective winding logs. If contact is desired, such contact can be controlled to a known position or interference or, alternatively, by regulating the contact force between the respective contact roll 30 and the respective winding log. Due to their position (disposed upon turret 40), each respective contact roll 30 cannot contact the respective winding log at the point where the incoming web material 22 first contacts the winding log. In other words, the respective contact roll 30 contacts the associated winding log at a point downstream of the point at which the web material 12 first contacts that particular winding log. It is believed that the application of a compressive force upon the winding log by the respective contact roll 30 can still increase the density of the finally wound product 24 disposed upon winding spindle 18.

Figure 6:
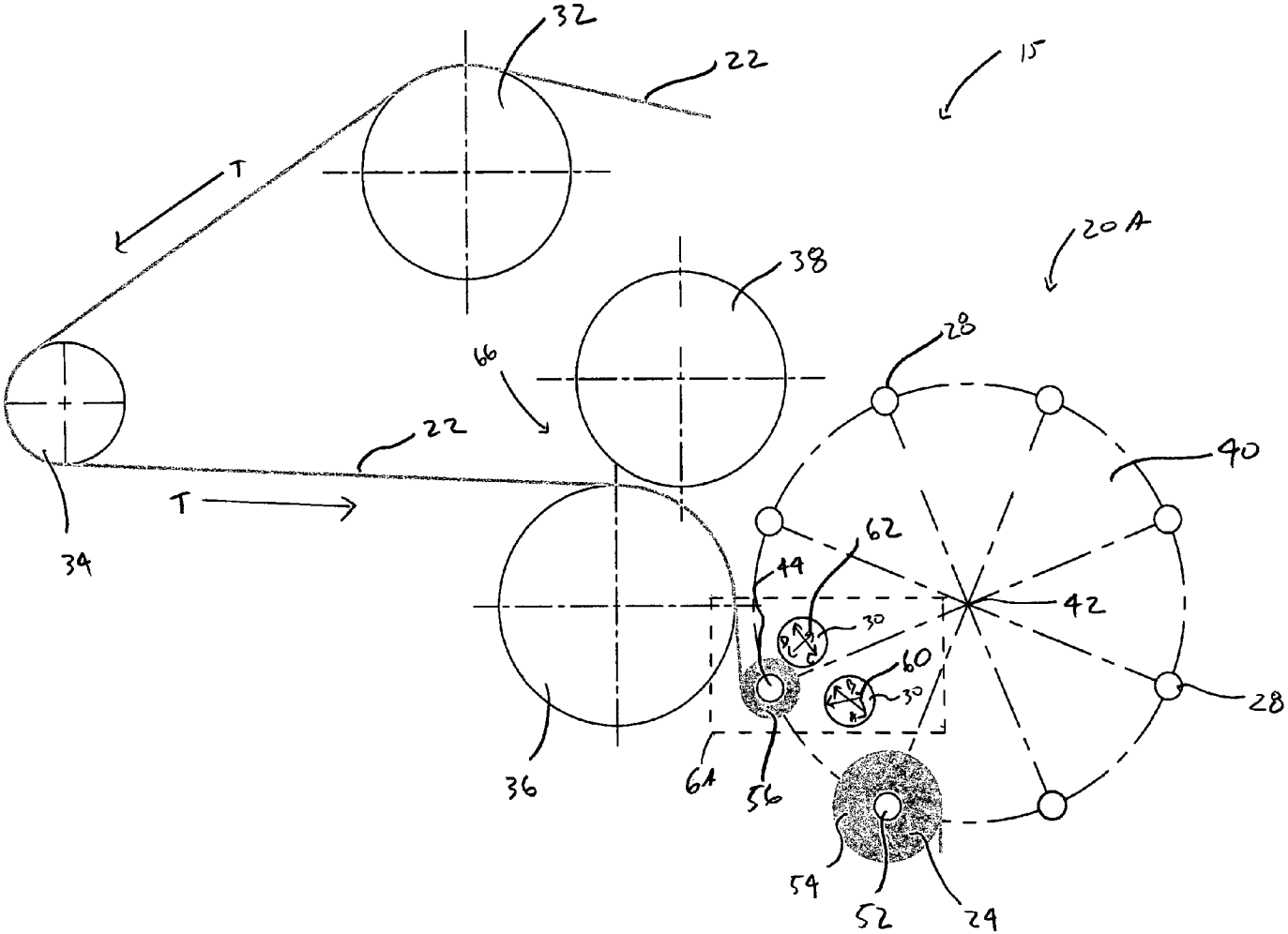
FIG. 6 is a cross-sectional view of the exemplary web winding system and winder shown in FIG. 5 at about 90 machine degrees.
Figure 6A:
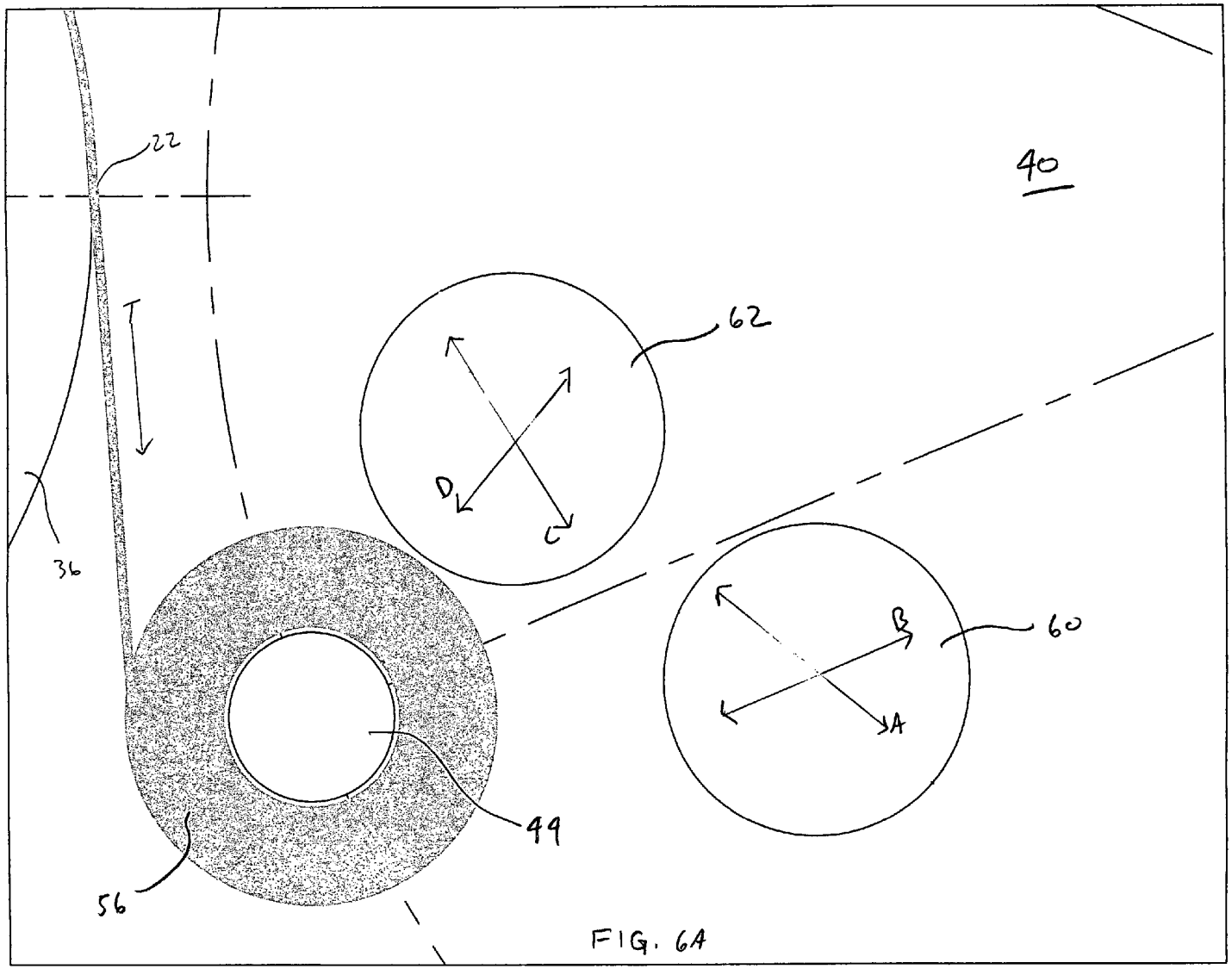
FIG. 6A is an expanded view of the region labeled 6A in FIG. 6.

FIGS. 6 and 6A depict the web winding system 15 and winder 20A of the instant invention at approximately 90 machine degrees. In this position, new log 56 is experiencing radial growth due to the continued deposition of web material 22 thereupon. The position of second contact roll 62 is adjusted along axes, C, D, or any other desired axes as required in order to provide the desired contact or pressure of the second contact roll 62 upon new log 56 being formed upon first winding spindle 44. Concurrently, first contact roll 60 is no longer in contacting engagement with old log 54 and can be adjusted along axes A, B, or any other desired axes required in order to assume a location proximate to new log 56 being wound about first winding spindle 44.

Figure 7:
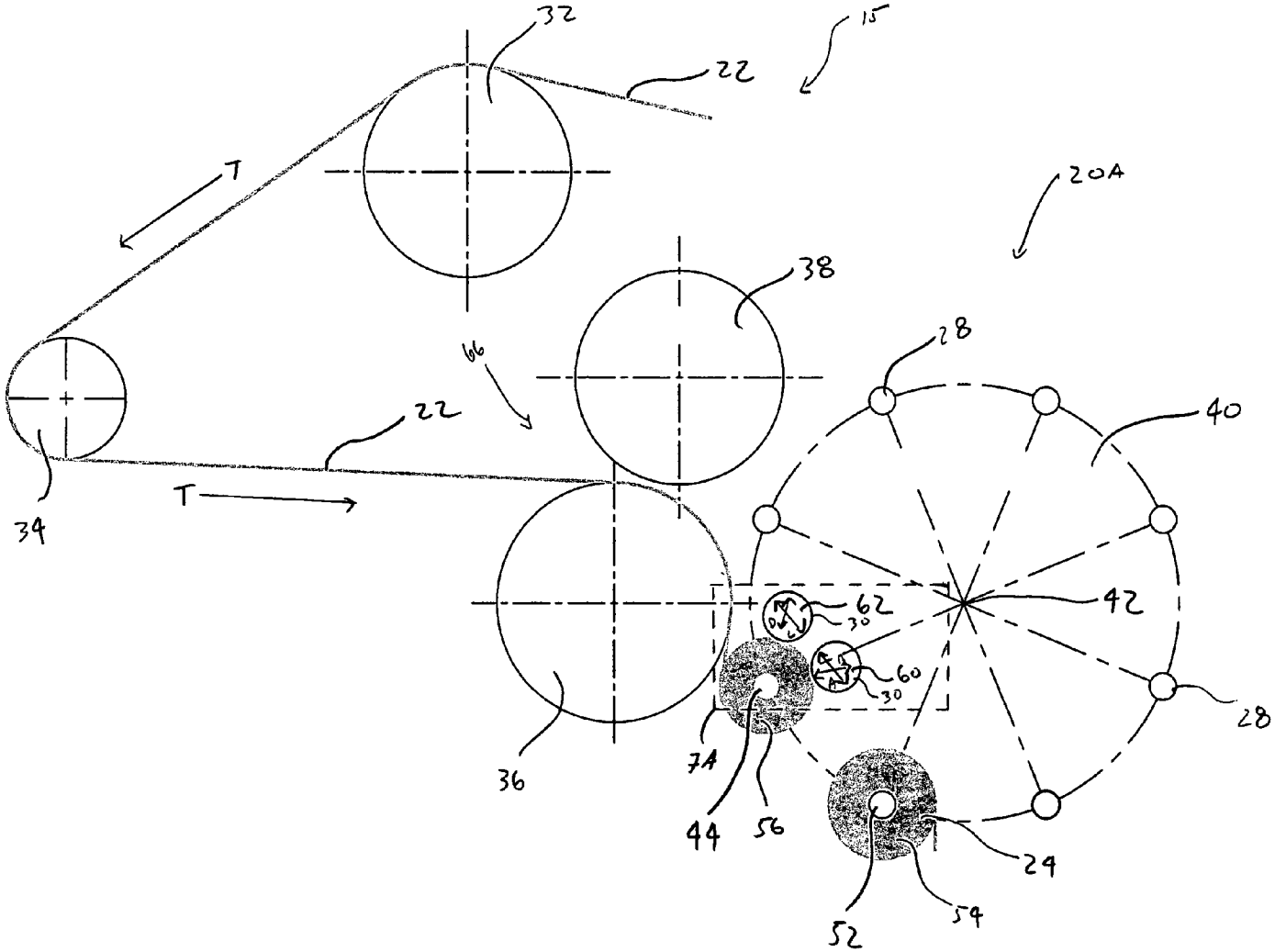
FIG. 7 is a cross-sectional view of the exemplary web winding system and winder shown in FIG. 5 at about 270 machine degrees.
Figure 7A:
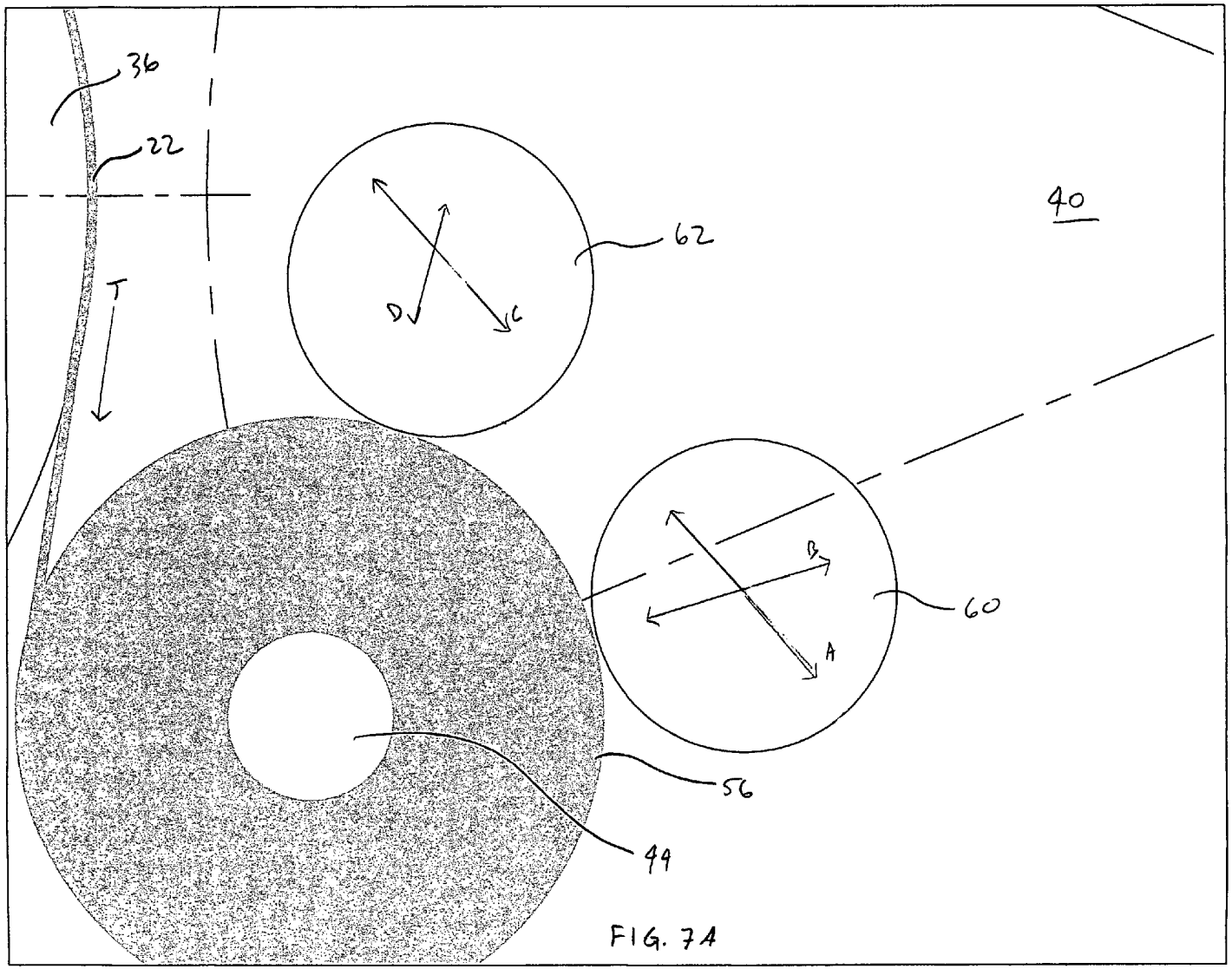
FIG. 7A is an expanded view of the region labeled 7A in FIG. 7.

FIGS. 7 and 7A depict the web winding system 15 and winder 20A of the instant invention at approximately 270 machine degrees. In this position, new log 56 is experiencing final radial growth due to the continued deposition of web material 22 thereupon. The position of the second contact roll 62 is adjusted along any of axes A, B, or any other desired axes as required in order to provide the desired contact or pressure of second contact roll 62 upon new log 56 in order to provide the desired wind profile as web material 22 is disposed thereon. Concurrently, first contact roll 60 is positioned in contacting engagement with new log 56 by movement of first contact roll 60 along axes, A, B, or any other axes desired. Further, bed roll 36 and chop-off roll 38 forming the web separator 66 assembly are each rotated to a position proximate to web material 22 disposed intermediate therebetween in order to facilitate separation of web material 22 at the desired perforation as described, supra.

Figure 8:
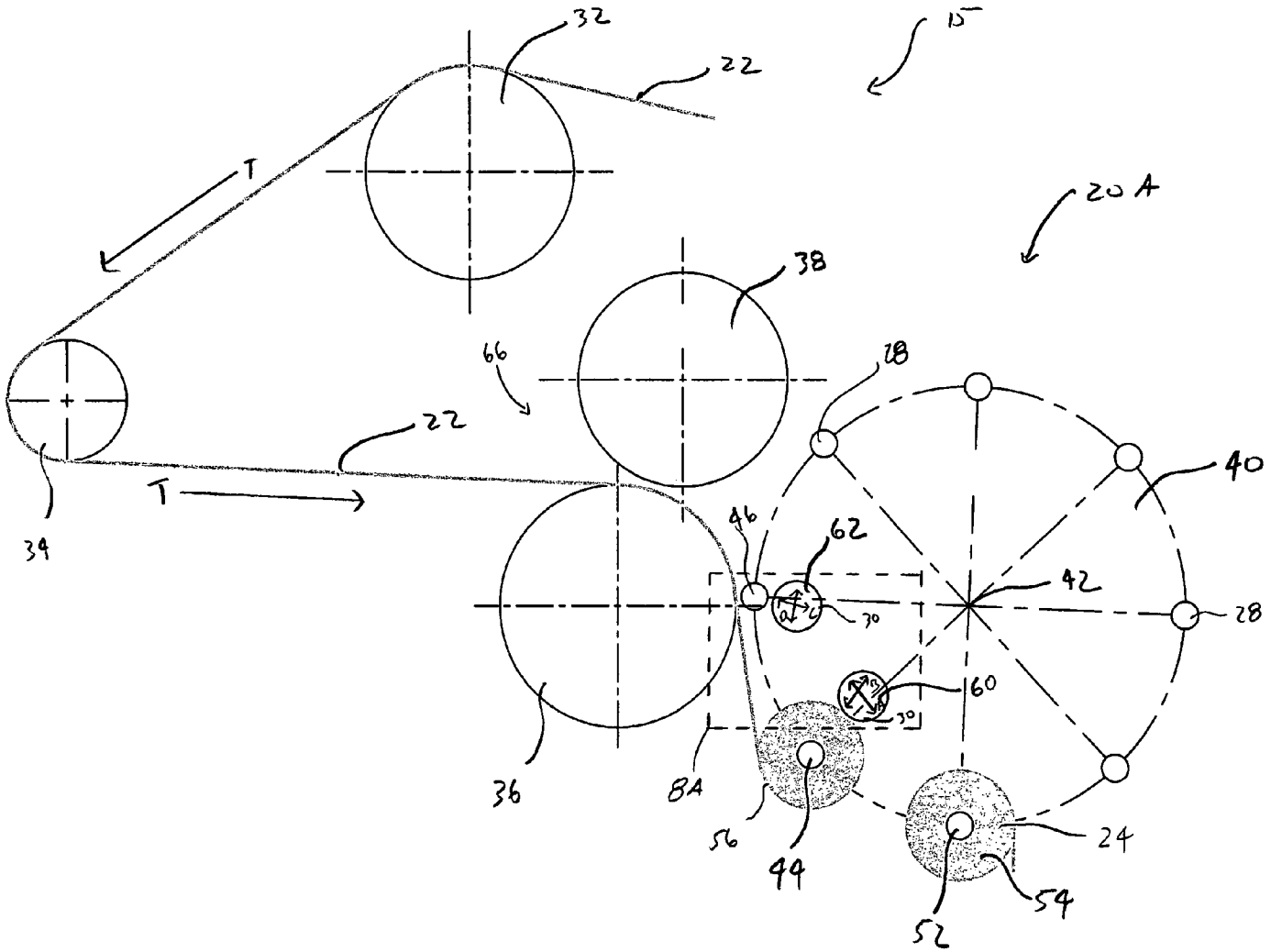
FIG. 8 is a cross-sectional view of the exemplary web winding system and winder shown in FIG. 5 at about 350 machines degrees.
Figure 8A:
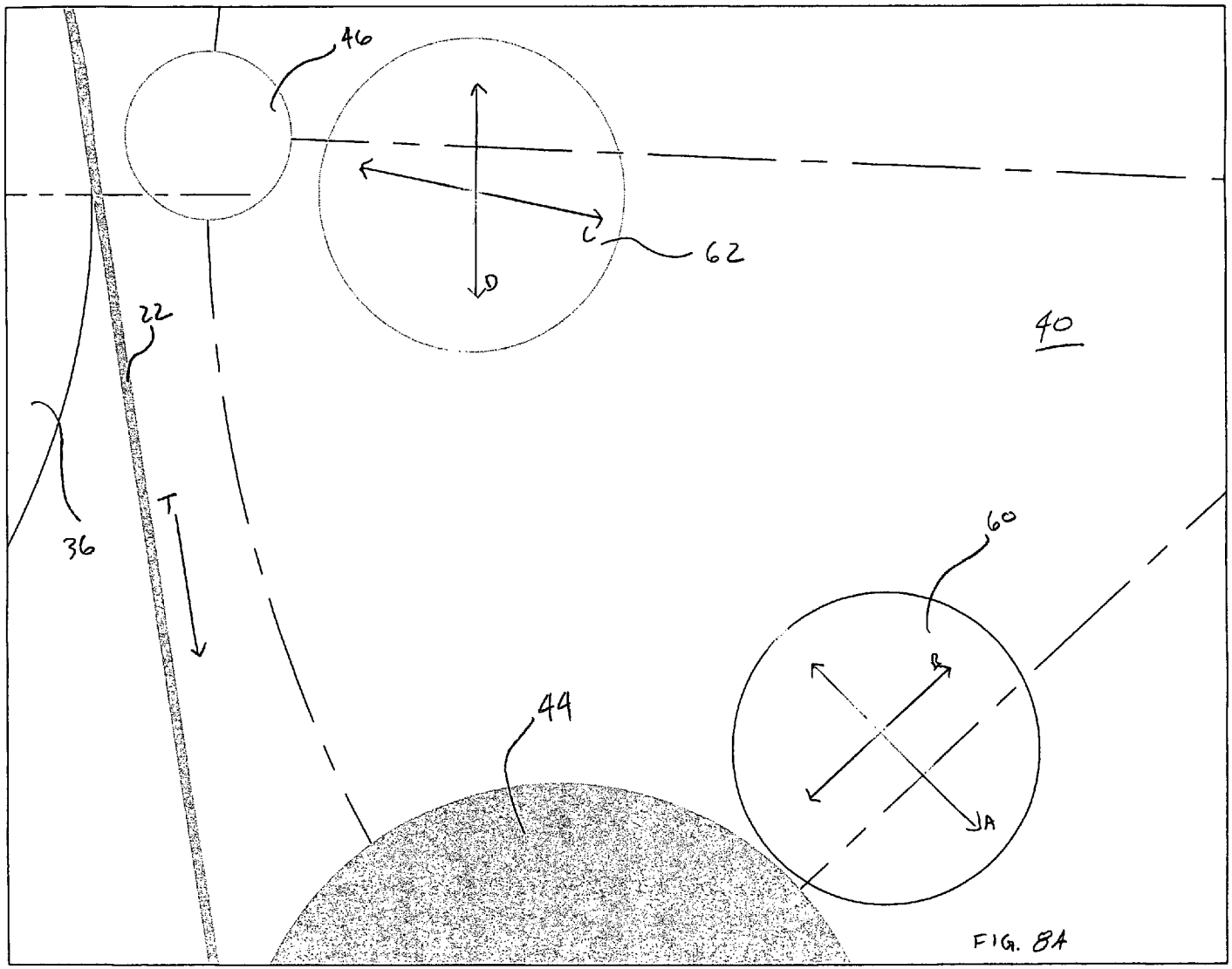
FIG. 8A is an expanded view of the region labeled 8A in FIG. 8.

As shown in FIGS. 8 and 8A, the web winding system 15 and winder 20A of the instant invention is depicted at approximately 350 machine degrees. At this point, new log 56 is experiencing final radial growth due to continued deposition of the web material 22 thereupon. The position of first contact roll 60 is adjusted along axes A, B, or any other desired axes in order to provide the desired contact or pressure of the first contact roll 60 upon new log 56 in order to provide the desired wind profile as the web material 22 is disposed thereon. Concurrently, second contact roll 62 is moved proximate to second winding spindle 46 that will form second new log 58. Second contact roll 62 can be moved along the axes C, D, or any other desired axes in order to provide the desired contact or pressure of the second contact roll upon second winding spindle 46. Additionally, bed roll 36 and chop-off roll 38 forming the web separator 66 and any peripheral portions associated thereto are moved to a position proximate to or in contacting engagement with web material 22 in order to facilitate separation of web material 22 at the desired perforation as described, supra. As required, old log 54 comprising finally wound product 24 can be removed from turret assembly 40.

Figure 9:
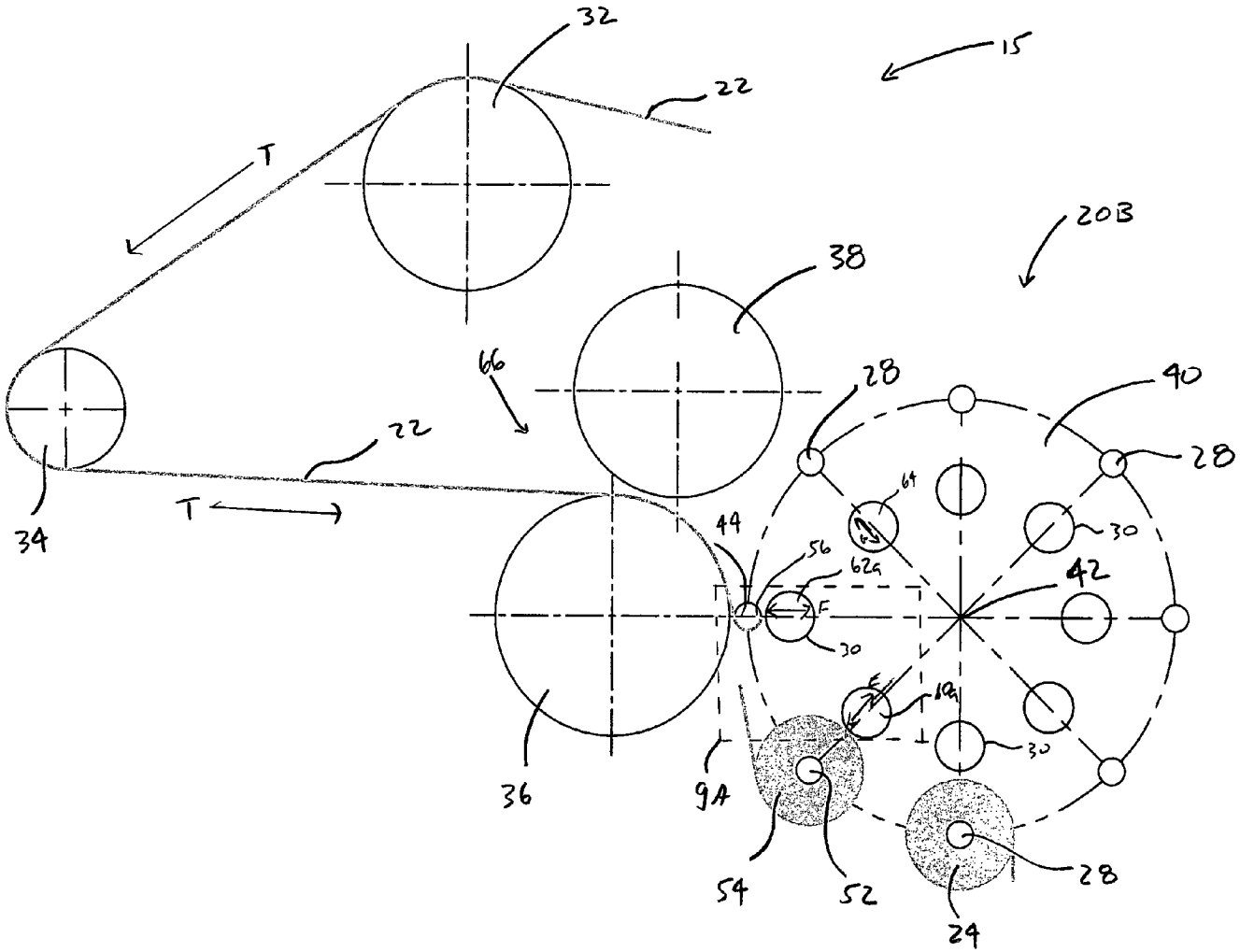
FIG. 9 is a cross-sectional view of an alternative embodiment of the web winding system and winder.
Figure 9A:
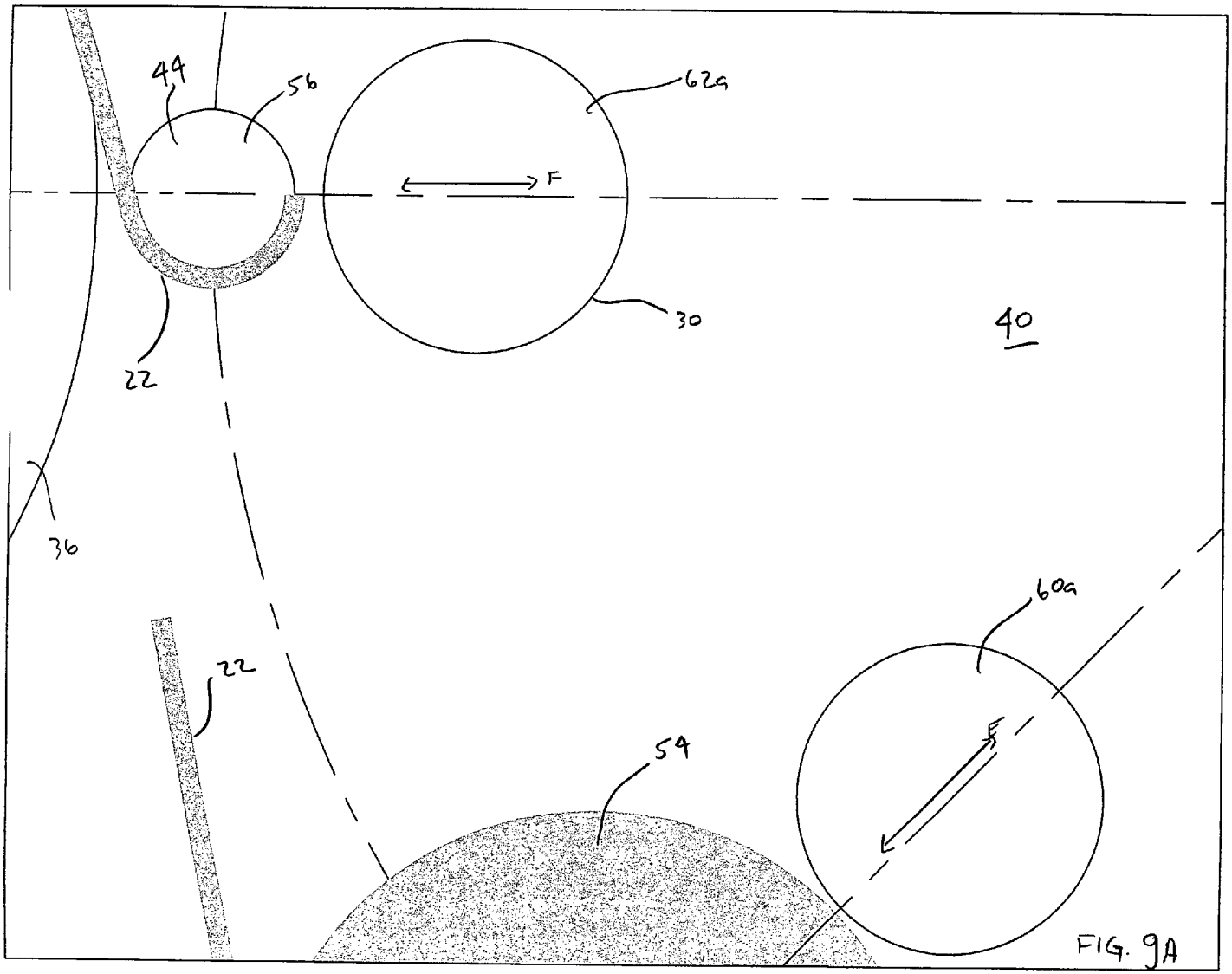
FIG. 9A is an expanded view of the region labeled 9A in FIG. 9.

FIGS. 9 and 9A depict an alternative embodiment of a web winding system 15 and winder 20B at approximately 0 machine degrees. In this embodiment, the turret 40 is provided with a plurality of winding spindles 28, each having a contact roll 30 cooperatively associated thereto. Each contact roll 30 can be provided with an axis of movement directed along a radial axis disposed from the turret axis of rotation 42. However, one of skill in the art will realize that each contact roll 30 can be provided with any desired axis of movement in order to provide the desired contact or pressure of the respective contact roll 30 upon associated spindle 28 forming the log that produces finally wound product 24. In any regard, new log 56 is beginning radial growth due to the deposition of web material 22 thereupon. The position of second contact roll 62A is adjusted along axis F in order to provide the desired contact or pressure of the second contact roll 62A upon new log 56 in order to provide the desired wind profile as web material 22 is disposed thereon. Concurrently, third contact roll 64 can be moved to a location proximate to the winding spindle 28 cooperatively associated thereto along exemplary axis G. Likewise, first contact roll 60A can be moved along exemplary axis E away from old log 54 in order to facilitate removal of old log 54 from the third winding spindle 52. This can facilitate removal of old log 54 from turret 40 for final processing.

Figure 10:
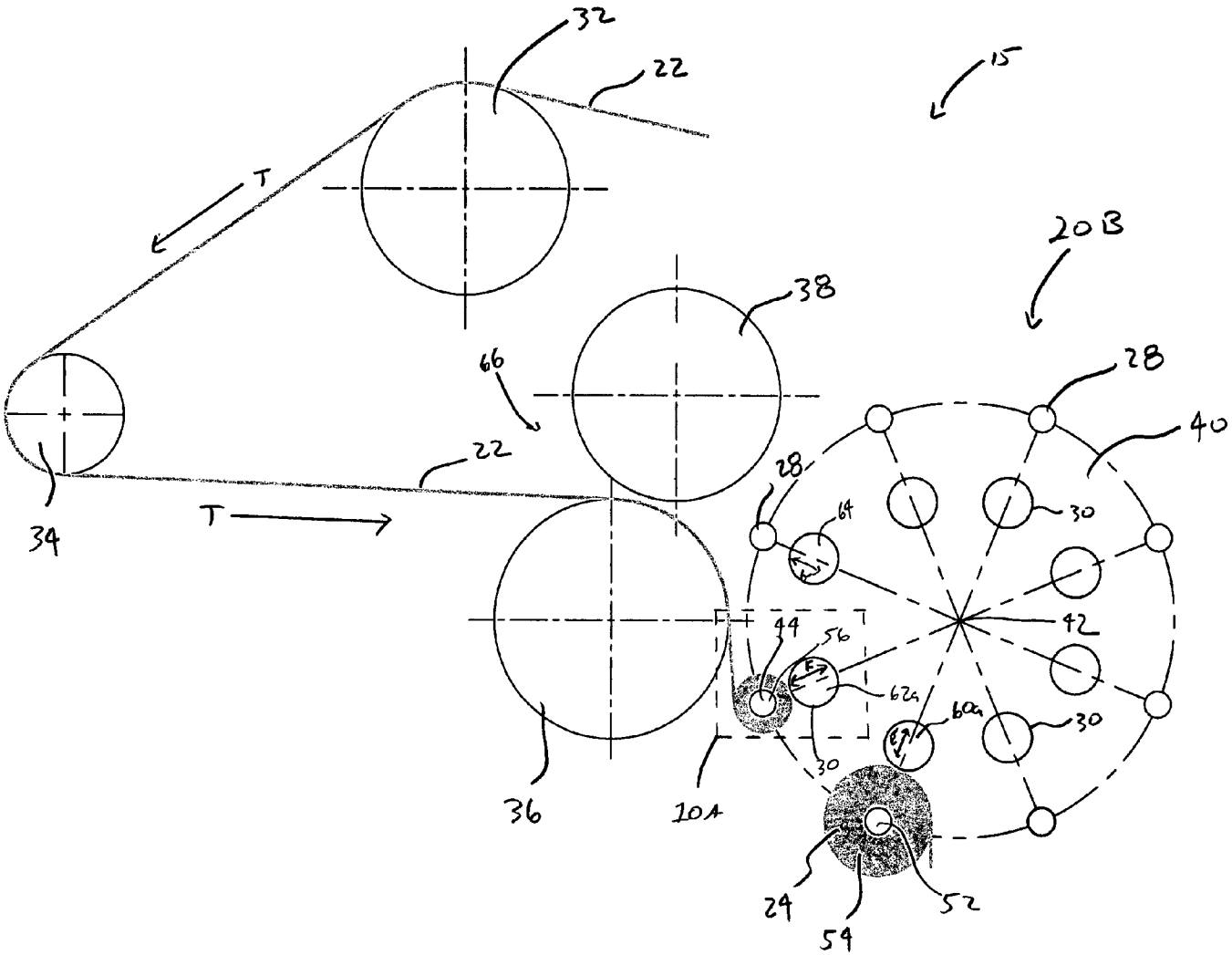
FIG. 10 is a cross-sectional view of the exemplary web winding system and winder shown in FIG. 9 at about 90 machine degrees.
Figure 10A:
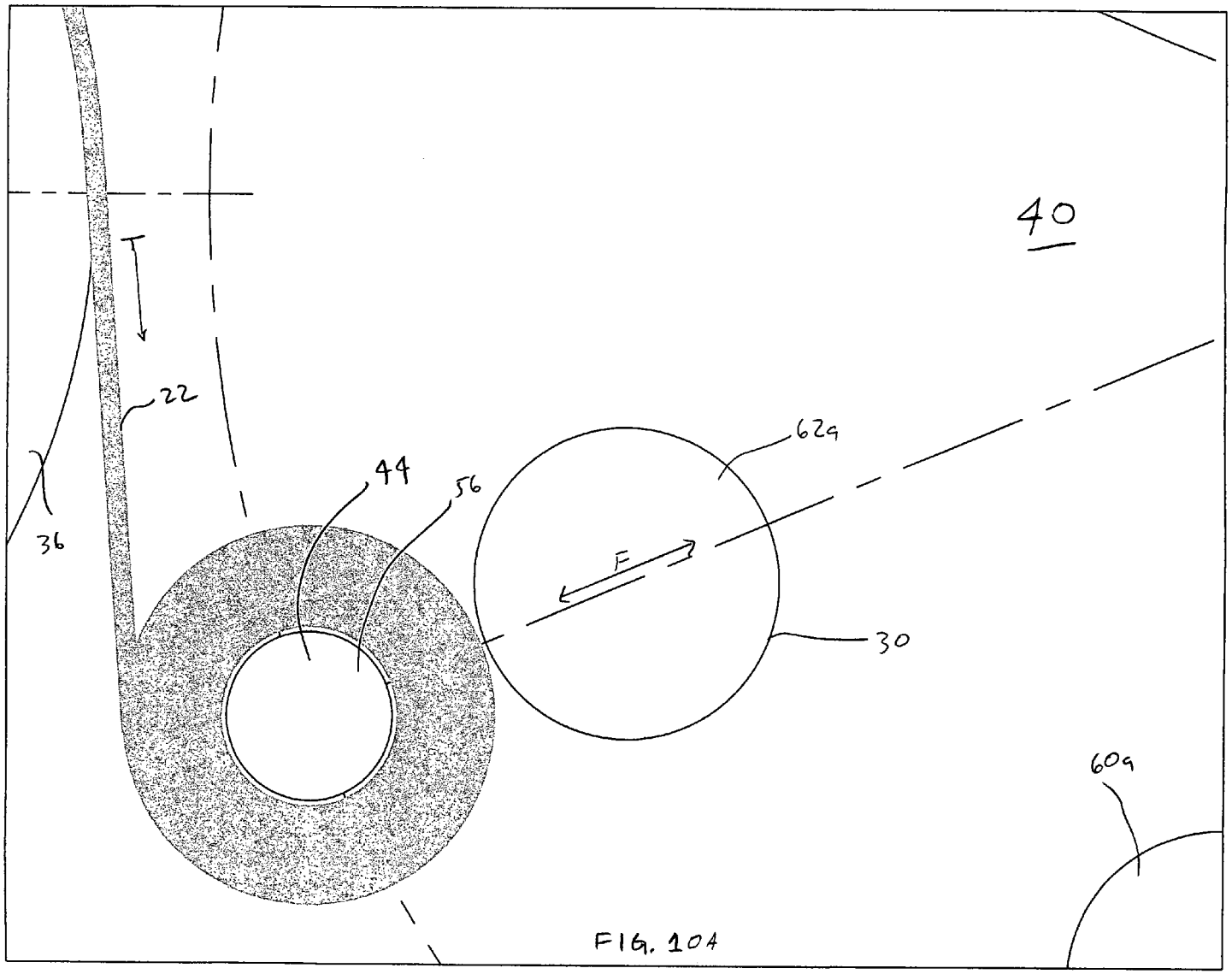
FIG. 10A is an expanded view of the regional labeled 10A in FIG. 10.

FIGS. 10 and 10A depict the web winding system 15 and winder 20B at approximately 90 machine degrees. At this point, new log 56 is continuing to experience radial growth due to the continued deposition of the web material 22 thereupon. The position of second contact roll 62A is adjusted along exemplary axis F in order to provide the desired contact or pressure of the second contact roll 62A upon new log 56 in order to provide the desired wind profile as web material 22 is disposed thereon. Concurrently, third contact roll 64 is moved along exemplary axis G in order to position third contact roll 64 in a position proximate the associated winding spindle 28. Likewise, first contact roll 60A can be moved along exemplary axis E away from old log 54 disposed upon third winding spindle 52 in order to facilitate removal of old log 54 from the turret 40.

Figure 11:
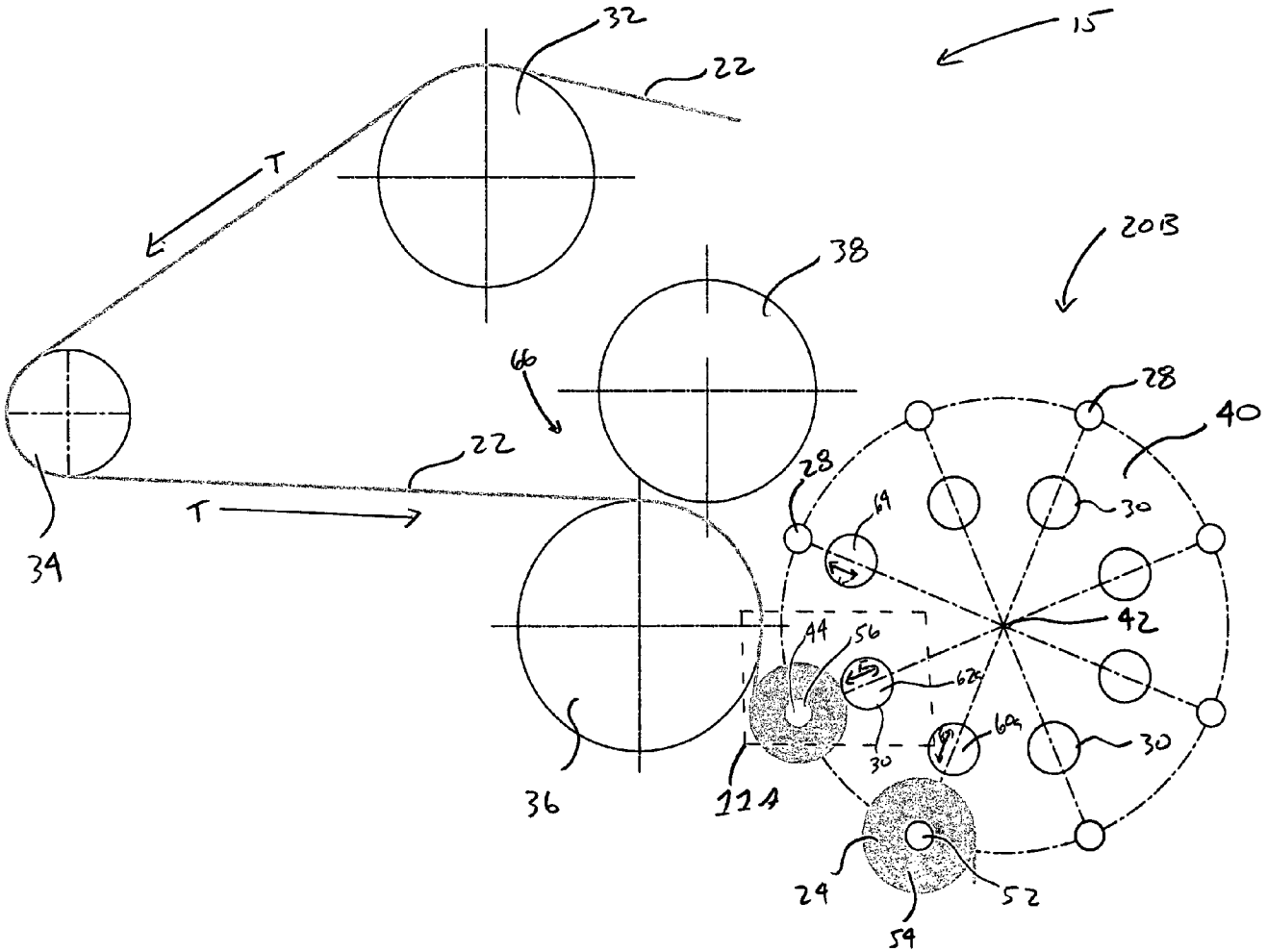
FIG. 11 is a cross-sectional view of the exemplary embodiment of the web winding system and winder shown in FIG. 9 at about 270 machine degrees.
Figure 11A:
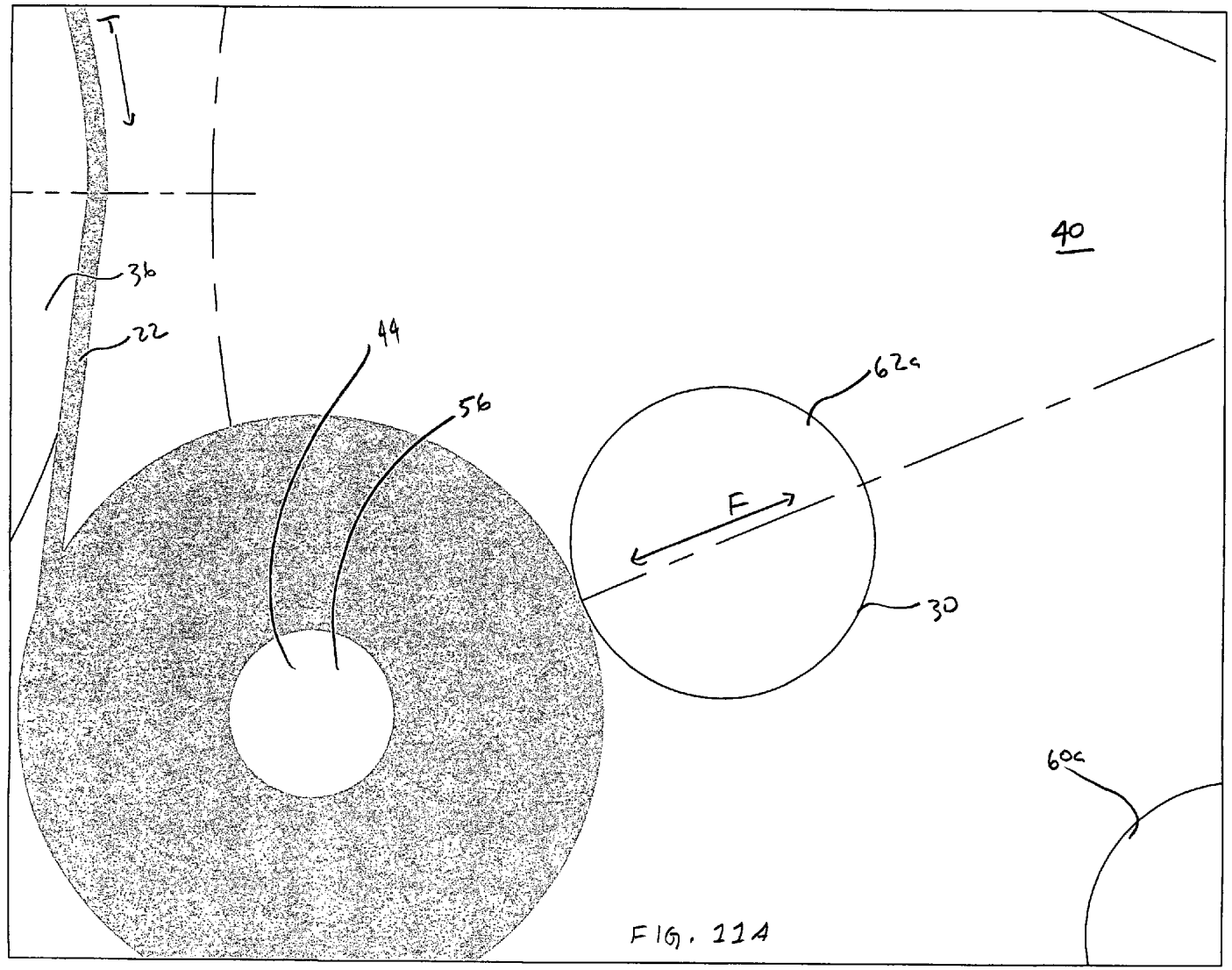
FIG. 11A is an expanded view of the region labeled 11A in FIG. 11.

FIGS. 11 and 11A depict the web winding system 15 and the winder 20B of the present invention at approximately 270 machine degrees. At this point, new log 56 continues to experience radial growth due to the continued deposition of web material 22 thereupon. The position of second contact roll 62A is adjusted along exemplary axis F in order to provide the desired contact or pressure of the second contact roll 62A upon new log 56 in order to provide the desired wind profile as web material 22 is disposed thereon. Concurrently, third contact roll 64 is moved to a position proximate to a winding spindle 28 cooperatively associated thereto that will form a new log (not shown) upon the deposition of web material 22 thereupon. Additionally, first contact roll 60A is moved along exemplary axis E away from old log 54 disposed upon third winding spindle 52 forming finally wound product 24. Displacement of first contact roll 60A away from third winding spindle 52 having old log 54 disposed thereon can facilitate removal of old log 54 from turret 40.

Figure 12:
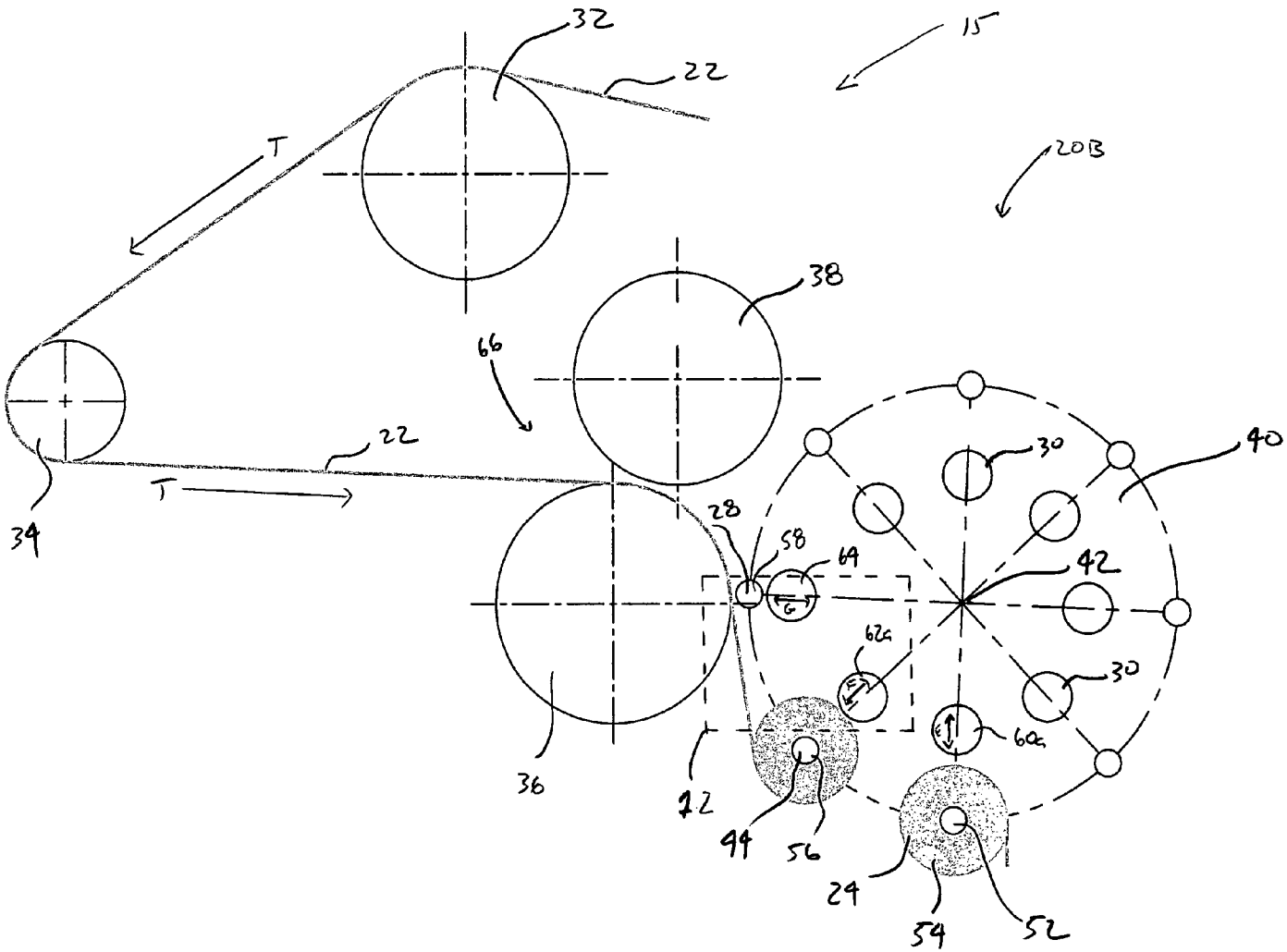
FIG. 12 is a cross-sectional view of the web winding system and winder shown in FIG. 9 at about 350 machine degrees; and, FIG. 12A is an expanded view of the region labeled 12A in FIG. 12.
Figure 12A:
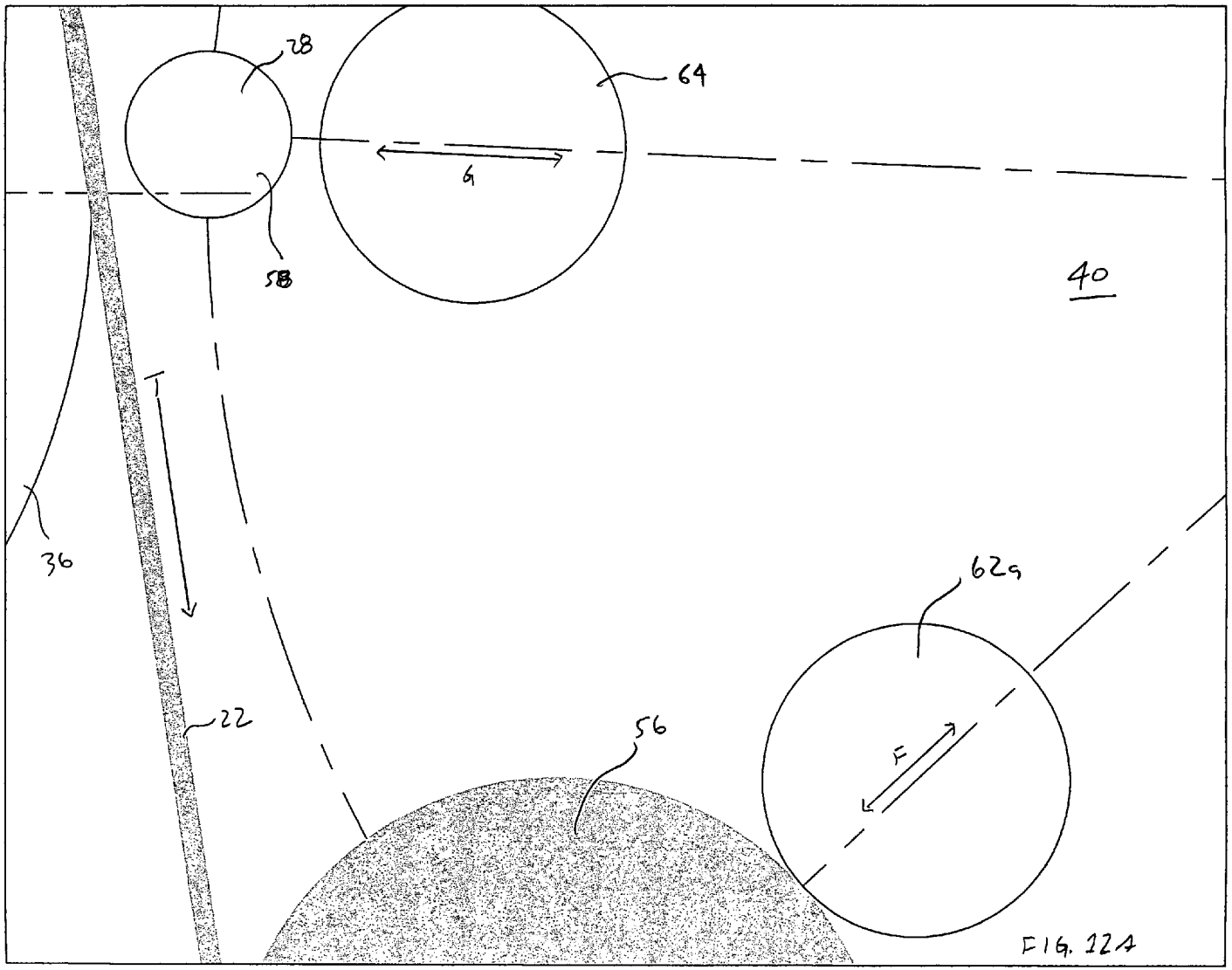

FIGS. 12 and 12A depict the web winding system 15 and the winder 20B of the instant invention at approximately 350 machine degrees. In this position, new log 56 is experiencing final radial growth due to the continued deposition of web material 22 thereupon. The position of second contact roll 62A is adjusted along exemplary axis F as required in order to provide the desired contact or pressure of second contact roll 62A upon new log 56 in order to provide the desired wind profile as the web material 22 is disposed thereon. Concurrently, third contact roll 64 is positioned proximate to a winding spindle 28 cooperatively associated thereto that will form a second new log 58. Further, the bed roll 36 and chop-off roll 38 forming the web separator 66 are each moved to a position proximate to web material 22 disposed intermediate therebetween in order to facilitate separation of web material 22 at the desired perforation as described, supra. In this regard, the movement of the bed roll 36 and chop-off roll 38 comprising the web separator 66 are timed such that they form a nip through which web material 22 passes and contact the web material 22 when the perforation at the trailing edge of the last desired sheet of web material 22 to be disposed upon first winding spindle 44 is located between the bed roll 36 and chop-off roll 38 comprising the web separator 66. In other words, concurrent with the nip formation by the bed roll 36 and chop-off roll 38 comprising the web separator 66, the material comprising web material 22 is provided with an elongate path which therefore causes the perforation located between the bed roll 36 and chop-off roll 38 to break resulting in the formation of the new log 56 having the desired number of sheets disposed thereon. The leading edge of the remaining web material 22 is then affixed to the respective winding spindle 28 that will form second new log 58.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for rewinding a web material, said method comprising the steps of:

disposing said web material on a winding spindle, said winding spindle being disposed upon and operatively associated with a winding turret;

cooperatively engaging a contact roll with said winding spindle when said web material is disposed therebetween, said contact roll being disposed upon and operatively associated with said winding turret;

determining a position of said contact roll relative to said winding spindle when said web is disposed therebetween;

determining a known diameter growth of said web material disposed upon said winding spindle;

providing an adjustable wind profile by comparing said position of said contact roll relative to said winding spindle with said known diameter growth; and, adjusting the position of said contact roll relative to said winding spindle as said web material is being disposed upon said winding spindle according to said adjustable wind profile.

2. The method according to claim 1 further comprising the step of operatively associating a plurality of winding spindles with said winding turret.

3. The method according to claim 2 further comprising the step of sequentially positioning each of said plurality of winding spindles proximate to said web material and transferring said web material to each of said winding spindles.

4. The method according to claim 1 further comprising the step of indexing said winding turret from a first winding position to a second winding position.

5. The method according to claim 1 further comprising the steps of disposing a core about said winding spindle and disposing said web material about said core when said winding spindle is proximate said web material.

6. The method according to claim 5 further comprising the step of disposing an adhesive upon said core.

7. The method according to claim 1 further comprising the step of providing a plurality of contact rolls.

8. The method according to claim 7, wherein said step of adjusting the position of said contact roll upon said winding turret relative to said winding spindle further comprises the step of adjusting the position of at least one of said plurality of contact rolls relative to said winding spindle as said web material is being disposed about said winding spindle.

9. The method according to claim 8, wherein said adjustment of said position of said at least one of said plurality of contact rolls changes a pressure exerted upon said web material by said at least one contact roll when said web material is disposed between said at least one contact roll and said winding spindle.

10. The method according to claim 8, wherein said position of said at least one contact roll relative to said winding spindle is adjustable according to a desired wind profile of said web material disposed about said winding spindle.

11. The method according to claim 1 further comprising the step of providing a plurality of perforations in said web material.

12. The method according to claim 11 further comprising the step of providing a web separator, said web separator being adapted to periodically pinch said web material proximate to one of said plurality of perforations.

13. The method according to claim 1 further comprising the step of providing said contact roll with a surface speed that is greater than a surface speed of said winding spindle having said web material disposed thereon.

14. The method according to claim 1 further comprising the steps of:

providing a second winding spindle cooperatively associated with said winding turret;

providing a second contact roll cooperatively associated with said winding turret; and, cooperatively associating said second contact roll with said second winding spindle.

15. The method according to claim 14 further comprising the step of cooperatively engaging said second contact roll with said second winding spindle when said web material is proximate and being disposed about said second winding spindle.

16. The method according to claim 14 further comprising the step of adjusting said second contact roll relative to said second winding spindle when said web material is being disposed about said second winding spindle.

17. The method according to claim 1 further comprising the steps of:

disposing a second winding spindle upon said winding turret; and, disposing a second contact roll upon said winding turret, said second contact roll being capable of cooperative engagement with said second winding spindle when said web material is disposed therebetween, at least one of said contact roll and said second contact roll being capable of maintaining cooperative engagement with either of said winding spindle and said second winding spindle for 360 machine degrees.

18. The method according to claim 1 further comprising the step of providing said winding spindle with a first winding speed and said contact roll with a second winding speed, said first and second winding speeds being different.

19. The method according to claim 1 further comprising the step of cooperatively disengaging said contact roll from said winding spindle after an amount of said web material is disposed upon said winding spindle.

* * * * *